US007055476B2

(12) United States Patent
Nakamura et al.

(10) Patent No.: US 7,055,476 B2
(45) Date of Patent: Jun. 6, 2006

(54) VALVE ACTUATION APPARATUS FOR INTERNAL COMBUSTION ENGINE

(75) Inventors: Makoto Nakamura, Kanagawa (JP); Mikihiro Kajiura, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/854,276

(22) Filed: May 27, 2004

(65) Prior Publication Data

US 2004/0237920 A1 Dec. 2, 2004

(30) Foreign Application Priority Data

Jun. 2, 2003 (JP) ..... 2003-156165
Jun. 2, 2003 (JP) ..... 2003-156166

(51) Int. Cl.
*F01L 1/34* (2006.01)

(52) U.S. Cl. ..... 123/90.16; 123/90.15; 123/90.2; 123/90.31; 123/90.34

(58) Field of Classification Search .. 123/90.15–90.17, 123/90.2, 90.27, 90.31, 90.34, 90.36, 90.44
See application file for complete search history.

(56) References Cited

U.S. PATENT DOCUMENTS 6,378,474 B1 * 4/2002 Pierik ..... 123/90.16
6,439,177 B1 * 8/2002 Pierik ..... 123/90.16
6,499,454 B1 12/2002 Miyazato et al.
6,550,437 B1 * 4/2003 Nakamura et al. ..... 123/90.16
6,745,734 B1 * 6/2004 Pierik ..... 123/90.16
6,810,846 B1 * 11/2004 Murata et al. ..... 123/90.36

FOREIGN PATENT DOCUMENTS

JP 2002-038913 A 2/2002

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

A VA apparatus for an internal combustion engine includes a pair of VO cams disposed on both sides of a crank cam and having inside end faces opposed to each other, wherein the inside end faces have therebetween an annular portion of the crank arm supported in a sandwiched way from the axial direction of a driving shaft.

23 Claims, 17 Drawing Sheets

VALVE ACTUATION APPARATUS FOR INTERNAL COMBUSTION ENGINE

BACKGROUND OF THE INVENTION

The present invention relates to a valve actuation (VA) apparatus for an internal combustion engine, and more particularly, to an improvement in positioning of a crank arm.

Typically, a VA apparatus for an internal combustion engine, adapted to the engine having two intake valves per cylinder, comprises a driving shaft that rotates in synchronism with a crankshaft, a crank cam arranged at the outer periphery of the driving shaft and having an axis eccentric with an axis of the driving shaft, and two cylindrical camshafts coaxially rotatably arranged at the outer periphery of the driving shaft.

The camshafts have a pair of valve operating (VO) cams integrated with the outer periphery to correspond to a pair of intake valves. Torque of the crank cam is transmitted to the VO cams through a transmission mechanism or multi-node linkage, opening/closing the intake valves through valve lifters.

The transmission mechanism comprises a rocker arm arranged above the VO cams and swingably supported on a control shaft through a control cam, a crank arm having at one end a circular portion rotatably linked to the crank cam and at another end a protrusion rotatably coupled to a first arm of the rocker arm between two forked portions through a pin, and a pair of link rods each having a first end rotatably coupled to a corresponding one of two bifurcated portions of a second arm of the rocker arm through a pin and a second end rotatably coupled to a cam nose of the VO cam.

The VO cams are arranged symmetric with respect to the crank cam (crank arm), and are swung at the same time by the bifurcated second arm to prevent occurrence of variations in opening/closing lift of the intake valves.

SUMMARY OF THE INVENTION

With the above VA apparatus, since transmission of torque of the crank cam to the VO cams is carried out through the multi-node linkage comprising crank arm, rocker arm, and link rod, various component members of the multi-node linkage are operated vigorously with engine operation. Thus, high dimension and positioning accuracies of the component members are required to restrain occurrence of wear thereof and operation noise therefrom.

With the crank arm of the multi-node linkage, particularly, the protrusion of another end is disposed between the two forked portions of the first arm of the rocker arm to restrict axial movement, having relative high positioning accuracy. On the other hand, the circular portion of one end slidably holding therein the crank cam has no restriction on movement in the axial direction of the driving shaft, having possibility of producing slight movement in the axial direction thereof. Then, the crank arm in its entirety can slightly be tilted in the axial direction of the driving shaft, resulting in fluttering thereof. This produces partial one-side collision, particularly, between the inner peripheral surface of the circular portion of the crank arm and the outer peripheral surface of the crank cam, raising easy occurrence of local wear of the crank arm and the crank cam, leading to a reduction in durability thereof.

SUMMARY

It is, therefore, an object of the present invention to provide a VA apparatus for an internal combustion engine, which contributes to an improvement in durability of the apparatus without having any local wear of the members.

The present invention provides generally a valve actuation (VA) apparatus for an internal combustion engine, comprising: a driving shaft which receives a torque of the engine; a crank cam which receives a torque of the driving shaft, the crank cam having an axis eccentric with an axis of the driving shaft; a crank arm comprising an annular portion to rotatably hold therein the crank cam, the crank arm converting the torque of the crank cam to a reciprocating force; a rocker arm which swings by a driving force derived from the crank arm; and a pair of valve operating (VO) cams swingably supported on the driving shaft, the VO cams swinging by a rocking force derived from the rocker arm to drive engine valves, the VO cams being disposed on both sides of the crank cam, the VO cams having inside end faces opposed to each other, the inside end faces having therebetween the annular portion of the crank arm supported in a sandwiched way from an axial direction of the driving shaft.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
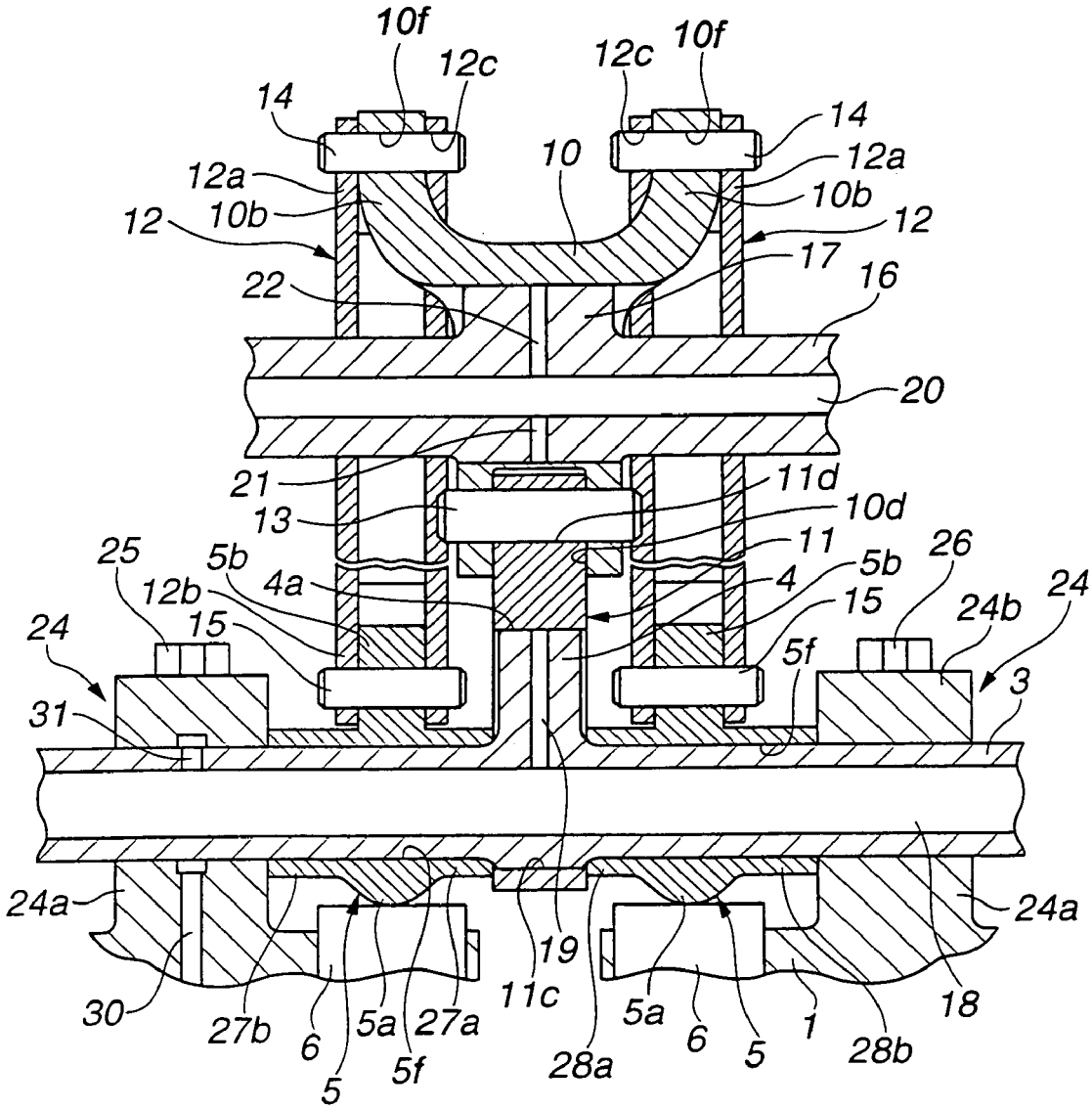
FIG. 1 is a sectional view showing a VA apparatus for an internal combustion engine embodying the present invention.

Referring to the drawings, a description is made about a VA apparatus for an internal combustion engine embodying the present invention. In the illustrative embodiments, the VA apparatus is applied to an internal combustion engine including two intake valves per cylinder and an alteration mechanism for varying the lift amount of the intake valves in accordance with the engine operating conditions.

Referring to FIGS. 1–5, there is shown first embodiment of the present invention. The VA apparatus comprises a pair of intake valves 2 slidably provided to a cylinder head 1 through valve guides, not shown, a hollow driving shaft 3 disposed in the engine longitudinal direction, a crank cam 4 fixed to driving shaft 3 in a predetermined position, a pair of VO cams 5 supported slidably on driving shaft 3 and disposed symmetric with respect to crank cam 4 and for opening/closing intake valves 2 through valve lifters 6, a transmission mechanism 7 connected between crank cam 4 and VO cams 5 for transmitting torque of crank cam 4 to VO cams 5 as their swinging force or valve opening force, and a control mechanism 8 for varying the operating position of transmission mechanism 7.

Figure 2:
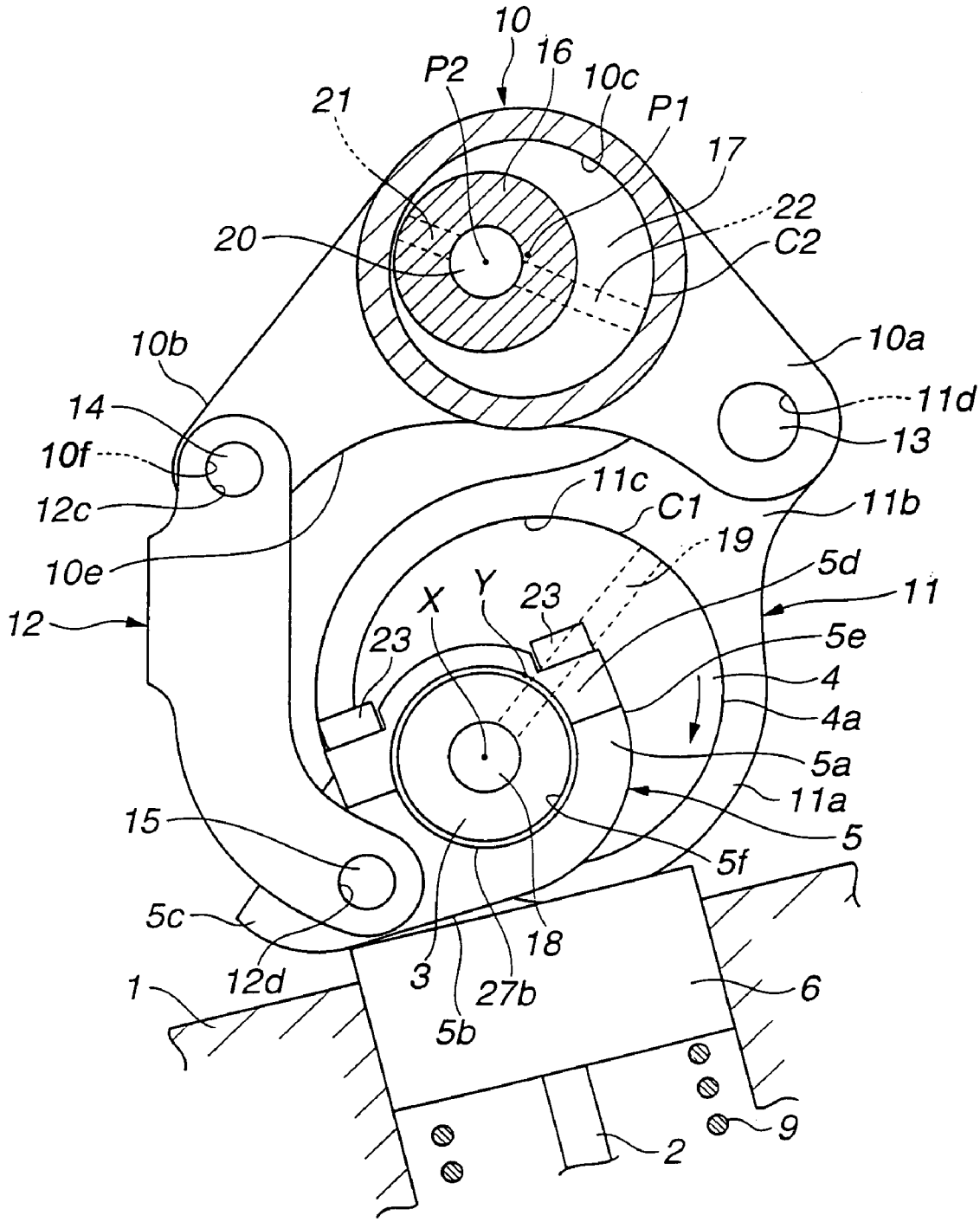
FIG. 2 is a side view, partly in section, showing the VA apparatus.

Referring to FIG. 2, each intake valve 2 is biased in the closing direction by a valve spring 9 arranged between the bottom of a roughly cylindrical bore arranged in an upper end of cylinder head 1 and a spring retainer arranged at an upper end of a valve stem.

Driving shaft 3 is disposed along the engine longitudinal direction, and has both ends rotatably supported by bearings 24 arranged in an upper portion of cylinder head 1. Driving shaft 3 receives torque from an engine crankshaft through a driven sprocket arranged at one end, a timing chain wound on the driven sprocket, and the like, not shown. Driving shaft 3 is rotated clockwise as viewed in FIG. 2. Referring to FIG. 1, bearings 24 are disposed outside intake valves 2, and each comprises: (a) a base 24*a* (which is integrated with the upper end of cylinder head 1 and has in the center a semicircular bearing groove); and (b) a bracket 24*b* (which is disposed on base 24*a* and has in the center a semicircular bearing groove). The bearing groove of the bracket 24*b* cooperates with the bearing groove of base 24*a* to support driving shaft 3. Brackets 24*b* are fixed to bases 24*a* by bolts 25, 26, respectively.

Figure 5:
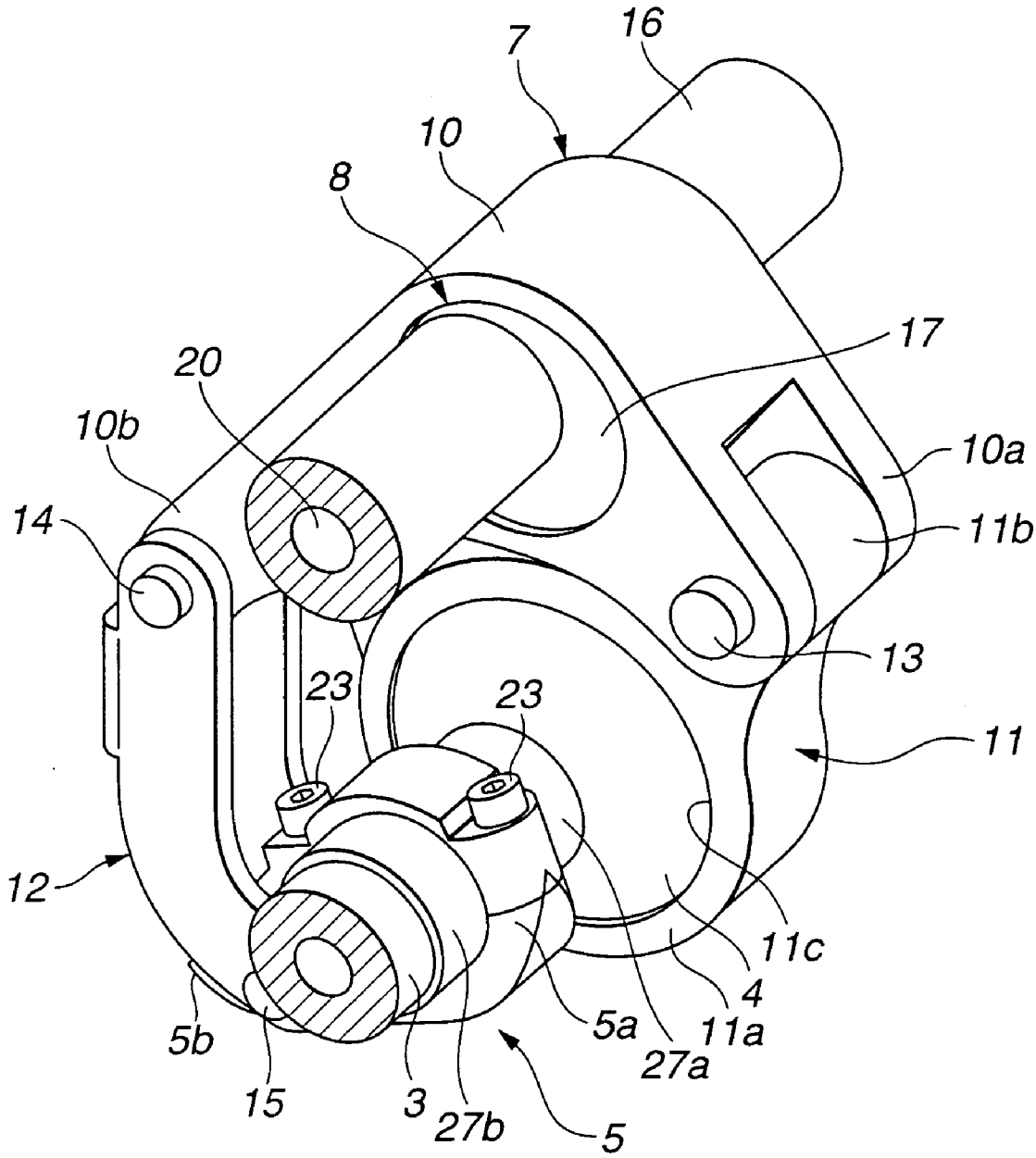
FIG. 5 is a view similar to FIG. 4, showing the VA apparatus.
Figure 6:
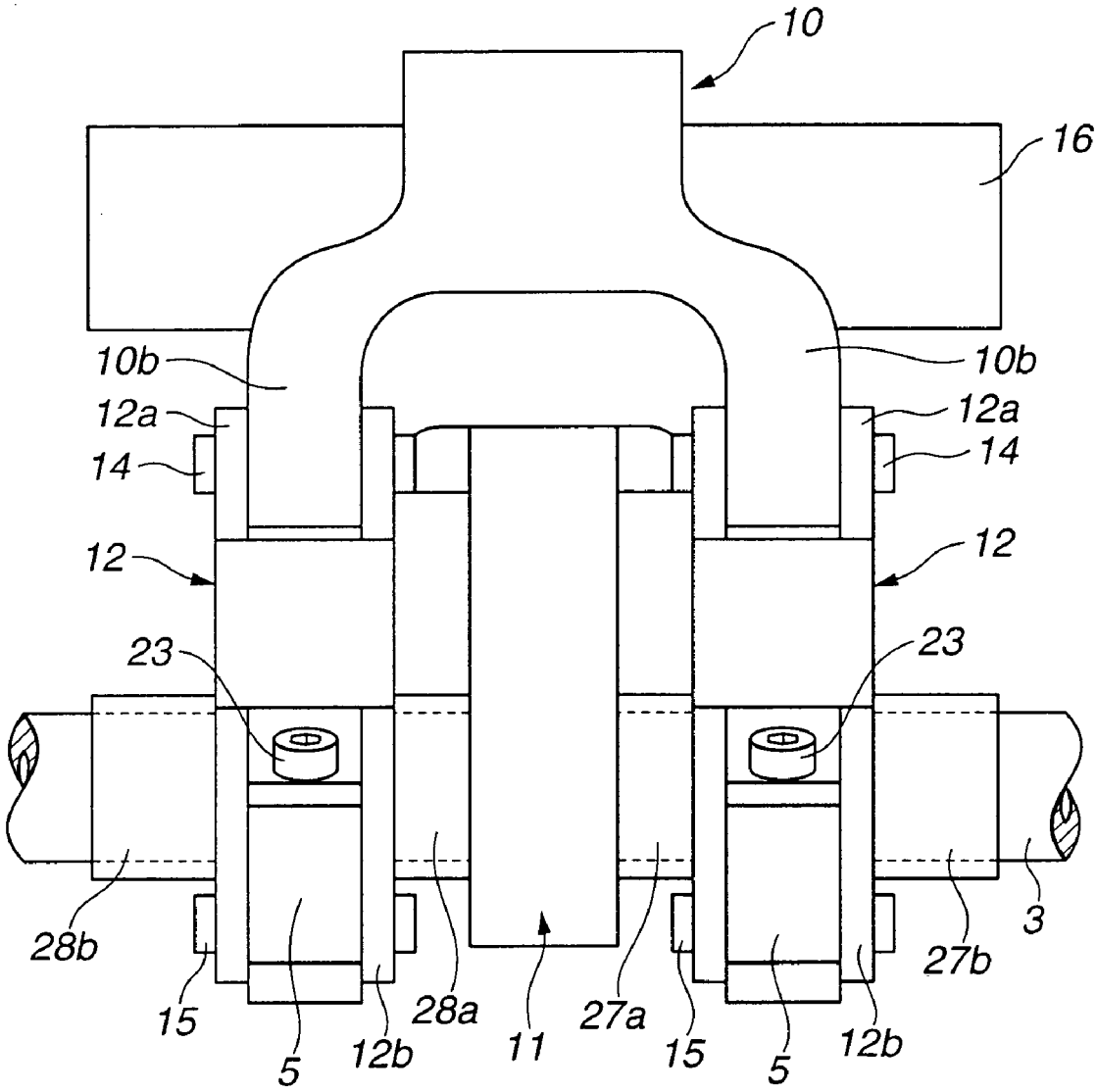
FIG. 6 is a front view showing the VA apparatus.

Referring to FIGS. 2 and 5, crank cam 4 having substantially a disc shape is integrally formed with driving shaft 3, and has a center Y offset with respect to an axis X of driving shaft 3 and an outer peripheral surface 4*a* formed with a cam profile of eccentric circle.

Referring to FIG. 2, VO cams 5 are both formed roughly like a raindrop, and have a base end 5*a* constructed to swing about axis X of driving shaft 3 through a camshaft and a cam face 5*b* formed on the underside. Cam face 5*b* includes a base-circle face on the side of base end 5*a*, a ramp face circularly extending from the base-circle face to a cam nose 5*c*, and a lift face extending from the ramp face to a top face with maximum lift arranged at a front end of cam nose 5*c*. The base-circle face, the ramp face, the lift face, and the top face make contact with predetermined points of the top face of valve lifter 6 in accordance with the swinging position of VO cam 5.

Referring to FIG. 2, base end 5*a* of VO cam 5 includes upper and lower divisions 5*d*, 5*e* obtained with respect to driving shaft 3 and coupled by bolts 23 from the vertical direction. In the coupled state, upper and lower divisions 5*d*, 5*e* have semicircular inner surfaces formed on cylindrical slide faces 5*f* which make slide contact with the outer peripheral surface of driving shaft 3.

Figure 4:
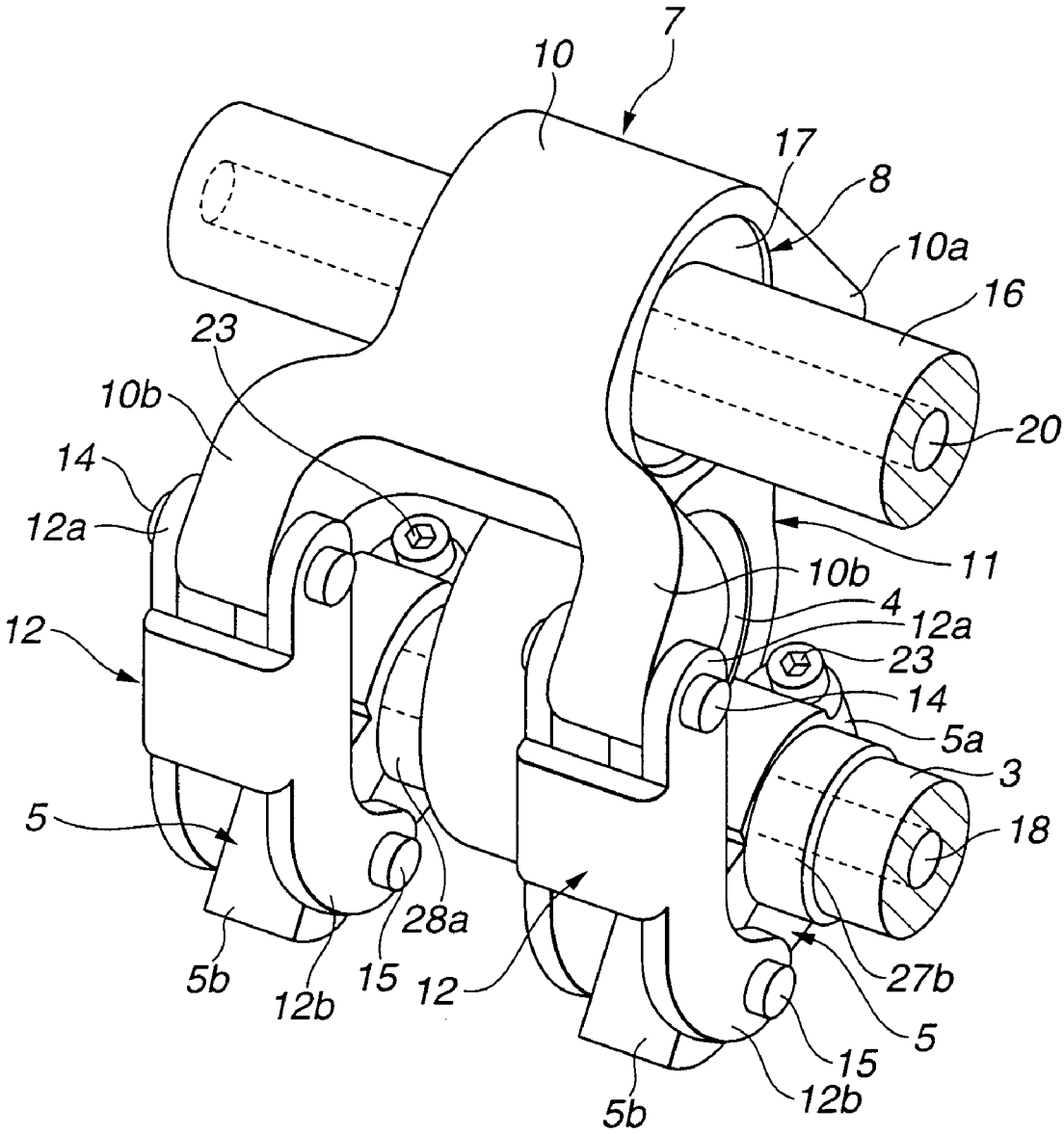
FIG. 4 is a perspective view showing the VA apparatus.

Referring to FIGS. 4 and 5, transmission mechanism 7 comprises a rocker arm 10 disposed above driving shaft 3, a crank arm 11 for linking a first arm 10*a* of rocker arm 10 with crank cam 4, and a pair of link rods 12 for linking a second arm 10*b* of rocker arm 10 with VO cams 5.

Figure 3:
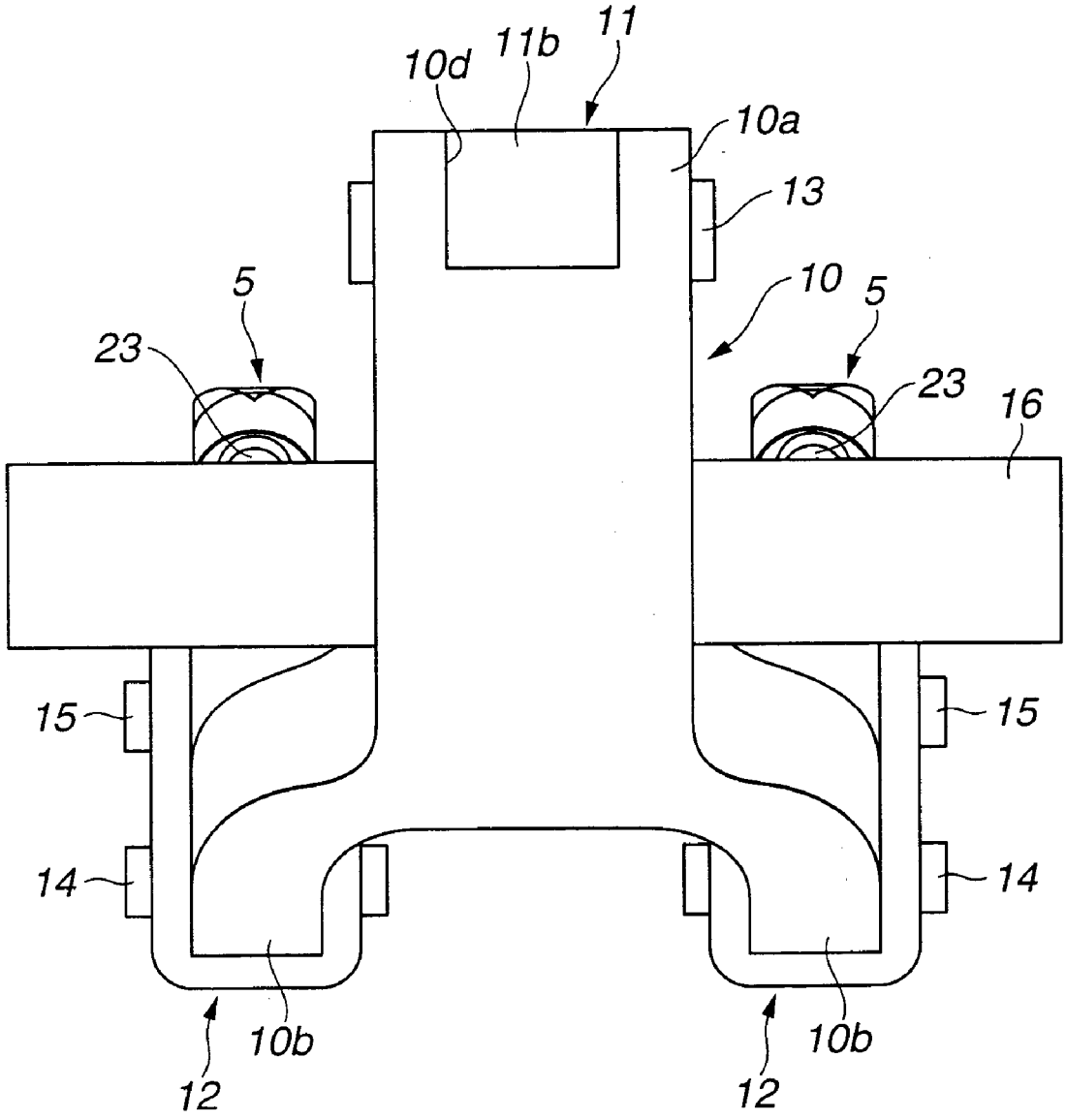
FIG. 3 is a plan view showing the VA apparatus.

Rocker arm 10 has in the center a cylindrical base with a support hole 10*c* formed therethrough from the lateral direction as shown in FIG. 2 and through which rocker arm 10 is swingably supported by a control cam 17 as will be described later. Referring to FIG. 3, first arm 10*a* extending from one radial side of the cylindrical base has in the center a recess 10*d* to provide two facing portions, whereas second arm 10*b* extending from another radial side of the cylindrical base has two bifurcated portions corresponding to two VO cams 5. Bifurcated second arms 10*b* are disposed symmetric with respect to the cylindrical base, each having at a front end a pin hole 10*f* formed therethrough for receiving a pin 14 for coupling second arm 10*b* to a first end 12*a* of link rod 12. Bifurcated second arms 10*b* serve to transmit a rocking force to VO cams 5 through link rods 12 from above in the direction of gravitation. Moreover, rocker arm 10 has a underside 10*e* facing crank cam 4 and including a concavely curved surface as a whole.

Referring to FIGS. 2 and 5, crank arm 11 includes at one end a relatively large-diameter annular portion 11*a* and at another end an extension 11*b* arranged in a predetermined position of the outer peripheral surface of annular portion 11*a*. Annular portion 11*a* has in the center an engagement hole 11*c* in which outer peripheral surface 4*a* of crank cam 4 is engaged rotatably. Extension 11*b* is engaged in recess 10*d* of first arm 10*a* of rocker arm 10, and is rotatably coupled to first arm 10*a* by a pin 13 arranged through a pin hole 11*d* formed axially. Annular portion 11*a* has slightly larger thickness or width in the axial direction of driving shaft 3 than that of crank cam 4, ensuring holding of crank cam 4 on the inside of annular portion 11*a*.

Referring to FIG. 4, link rod 12 is formed to have substantially a C-shaped cross section by press working, and has in the vicinity of each end 12*a*, 12*b* two facing plate portions formed with a pin hole 12*c*, 12*d*. Arranged through pin holes 12*c*, 12*d* are pin 14 for rotatably coupling end 12*a* to second arm 10*b* of rocker arm 10 and a pin 15 for rotatably coupling end 12*b* to cam nose 5*c* of VO cam 5.

Referring to FIGS. 4 and 5, control mechanism 8 comprises a control shaft 16 rotatably supported on a bearing, not shown, disposed above cylinder head 1, and a control cam 17 fixed to the outer periphery of control shaft 16 to form a rocking fulcrum of rocker arm 10.

Control shaft 16 is disposed parallel to driving shaft 3 to extend along the engine longitudinal direction, and is controlled in rotation within a predetermined angle of rotation through a gear mechanism by an electric actuator or DC motor, not shown, arranged at one end. Control cam 17 is shaped cylindrically, and has an axis P1 offset by an amount of the thick portion with respect to an axis P2 of control shaft 16.

The electric actuator is driven by a control signal of an electric control unit (ECU), not shown, for determining the engine operating conditions. The ECU comprises a microcomputer, and determines through computing and the like current engine operating conditions in accordance with detection signals of various sensors such as a crank-angle sensor, an airflow meter, a coolant-temperature sensor, and a potentiometer for detecting the rotated position of control shaft 16, providing a control signal to the electric actuator.

Referring to FIG. 1, cylindrical extensions 27*a*, 27*b*, 28*a*, 28*b* are integrated with VO cams 5 on the end faces opposite to base ends 5*a*, i.e. at the hole edges of slide faces 5*f*. Extensions 27*a*, 27*b*, 28*a*, 28*b* have total axial length including length of base ends 5*a*, which extend from the opposite faces of bearings 24 to the neighborhood of both axial side faces of annular portion 11*a* of crank arm 11, supporting annular portion 11*a* in such a way as to hold it by opposite inner end faces of opposite inside extensions 27*a*, 28*a*. On the other hand, the outer end faces of extensions 27*b*, 28*b* abut on the opposite faces of bearings 24. Thus, annular portion 11*a* is restricted in axial free movement by extensions 27*a*, 27*b*, 28*a*, 28*b* through bearings 24.

A lubricating-oil supply circuit is arranged to carry out lubrication between outer peripheral surface 4*a* of crank cam 4 and the inner peripheral surface of engagement hole 11*c* of crank arm 11 and between the outer peripheral surface o control cam 17 and the inner peripheral surface of support hole 10*c* of rocker arm 10.

Specifically, referring to FIGS. 1 and 2, the lubricating-oil supply circuit comprises a first oil passage 18 formed through driving shaft 3 axially, a first communication passage 19 formed through crank cam 4 radially to provide fluid communication between first oil passage 18, outer peripheral face 4*a* of crank cam 4, and engagement hole 11*c* of crank arm 11, a second oil passage 20 formed through control shaft 16 axially, a diametral hole 21 formed through control shaft 16 diametrally to communicate with second oil passage 20, and a second communication passage 22 formed through a thick portion of control cam 17 radially to provide fluid communication between diametral hole 21, the inner surface of support hole 10*c* of rocker arm 10, and the outer surface of control cam 17.

Lubricating oil is introduced into first oil passage 18 from an oil gallery arranged in cylinder head 1 via an oil introduction passage 30 formed through bearing 24 and an oil hole 31 formed through a peripheral wall of driving shaft 3 radially. Lubricating oil is also introduced into second oil passage 20 from the oil gallery via an oil introduction passage formed through a bearing, not shown, and an oil hole formed through crank shaft 16 radially.

Figure 7A:
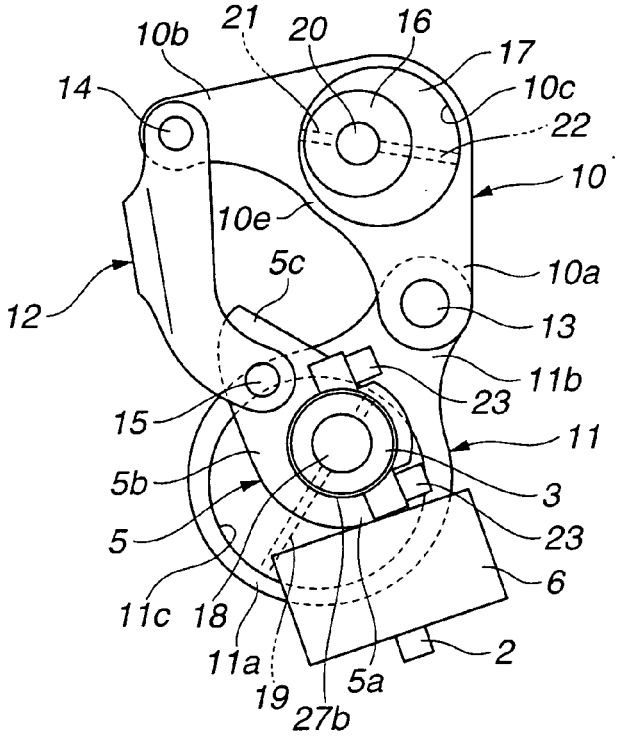
FIG. 7A is a schematic view for explaining closing operation of an intake valve during minimum lift control of the VA apparatus.

Operation of the alteration mechanism in the first embodiment is described briefly. During low lift control, control shaft 16 is rotated in one direction by the electric actuator in accordance with a control signal of the ECU. Thus, referring to FIGS. 7A and 7B, the thick portion of control cam 17 is rotated rightward as viewed in FIGS. 7A and 7B with respect to control shaft 16, having control cam 17 held in this rotation-angle position. With this, second arm 10*b* of rocker arm 10 is rotated upward, so that cam nose 5*c* of VO cam 5 is forcedly pulled up through link rod 12, having VO cam 5 in its entirety held in a clockwise rotated position as shown in FIG. 7A.

Figure 7B:
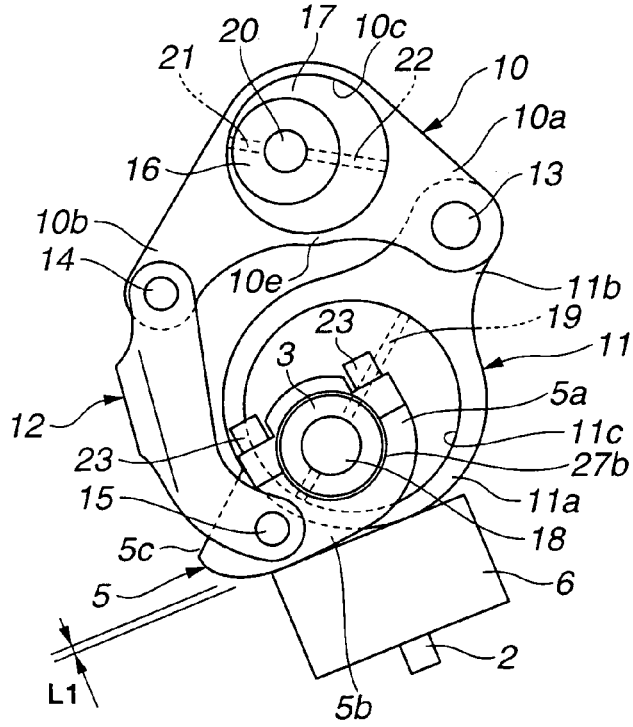
FIG. 7B is a view similar to FIG. 7A, for explaining opening operation of the intake valve during minimum lift control of the VA apparatus.

Referring to FIG. 7B, when rotation of crank cam 4 urges crank arm 11 to pull up first arm 10*a* of rocker arm 10, a corresponding lift amount is transmitted to VO cam 5 and valve lifter 6 through link rod 12. Then, the lift amount is sufficiently small.

This leads to small valve lift amount L1 and delayed opening timing of intake valves 2, reducing valve overlap with the exhaust valves, thus obtaining enhancement in fuel consumption and stable engine rotation in the low load range, for example.

Figure 8A:
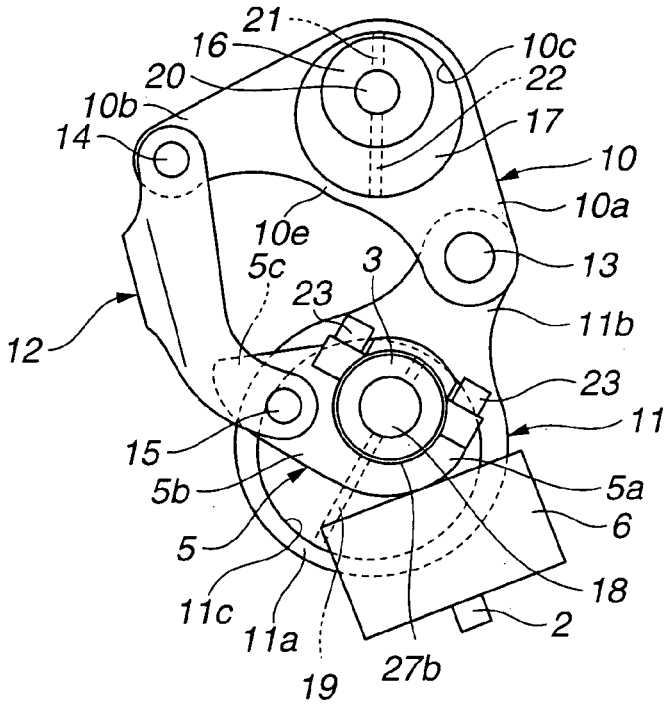
FIG. 8A is a view similar to FIG. 7B, for explaining closing operation of an intake valve during maximum lift control of the VA apparatus.
Figure 8B:
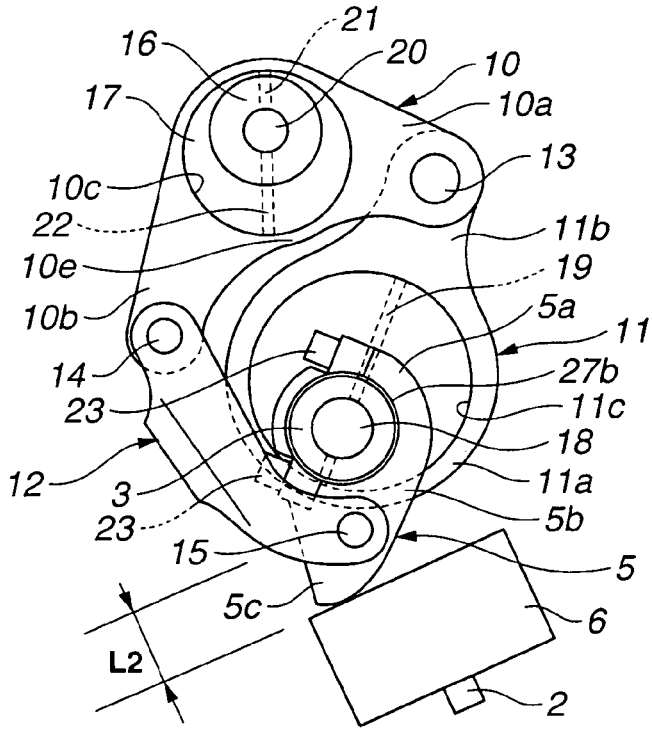
FIG. 8B is a view similar to FIG. 8A, for explaining opening operation of the intake valve during maximum lift control of the VA apparatus.

On the other hand, during high lift control, control shaft 16 is rotated in another direction by the electric actuator in accordance with a control signal of the ECU. Thus, referring to FIGS. 8A and 8B, control shaft 16 rotates control cam 17 up to a predetermined rotation-angle position to have the thick portion moved downward. With this, second arm 10*b* of rocker arm 10 is rotated downward, so that cam nose 5*c* of VO cam 5 is pressed downward through link rod 12, having VO cam 5 in its entirety held in a clockwise rotated position as shown in FIG. 8B.

Therefore, the contact position of cam face 5*b* of VO cam 5 with respect to the top face of valve lifter 6 is moved on the side of cam nose 5*c*. Referring to FIG. 8B, when rotation of crank cam 4 urges crank arm 11 to pull up first arm 10*a* of rocker arm 10, a corresponding lift amount is large with respect to valve lifter 6.

This leads to large valve lift amount L2 and delayed closing timing of intake valves 2, obtaining enhancement in intake charging efficiency in the high load range and sufficient engine output, for example.

Moreover, in the first embodiment, crank arm 11 has extension 11*b* held in recess 10*d* of first arm 10*a* of rocker arm 10 to have restricted side-to-side movement, and annular portion 11*a* supported by extensions 27*a*, 27*b*, 28*a*, 28*b* of VO cams 5 in the sandwiched state, i.e. in the state of producing no inconvenience to operation of crank arm 11 and VO cams 5, having restricted free axial movement. As a result, crank arm 11 is prevented from being tilted, preventing occurrence of partial one-side collision between the inner peripheral surface of engagement hole 11*c* of annular portion 11*a* of crank arm 11 and outer peripheral surface 4*a* of crank cam 4.

Therefore, wear of the inner peripheral surface of engagement hole 11*c* and outer peripheral surface 4*a* of crank cam 4 is prevented from occurring, leading to a reduction in durability thereof.

Next, operation of the lubricating-oil supply circuit in the first embodiment is described. Referring to FIGS. 1 and 2, during engine operation, lubricating oil flowing into first oil passage 18 is supplied to a first slide clearance C1 between the inner peripheral surface of engagement hole 11*c* and outer peripheral surface 4*a* of crank cam 4 through first communication passage 19. Thus, forced lubrication is carried out between the inner peripheral surface of engagement hole 11*c* and outer peripheral surface 4*a* of crank cam 4, obtaining enhanced lubrication performance therebetween.

Therefore, in combination with restricting operation of free side-to-side movement of annular portion 11*a* of crank arm 11, wear of annular portion 11*a* and crank cam 4 can effectively be prevented from occurring.

Moreover, lubricating oil flowing out from slide clearance C1 between the inner peripheral surface of engagement hole 11*c* and outer peripheral surface 4*a* of crank cam 4 is also supplied between the outside faces of annular portion 11*a* and the opposite ends of extensions 27*a*, 27*b*, 28*a*, 28*b* of VO cams 5, obtaining enhanced lubrication performance therebetween. Further, lubricating oil supplied to the opposite ends of extensions 27*a*, 27*b*, 28*a*, 28*b* drops on the top faces of valve lifters 6, obtaining enhanced lubrication performance between the top faces of VO cams 5 and valve lifters 6.

On the other hand, lubricating oil flowing into second oil passage 20 is supplied to a second slide clearance C2 between the inner face of support hole 10*c* and the outer face of control cam 17 through diametral hole 21 and second communication hole 22. Thus, forced lubrication is carried out between control cam 17 and rocker arm 10.

In the first embodiment, VO cams 5 have base ends 5*a* each formed dividedly, allowing integration of driving shaft 3 and crank cam 4.

Specifically, when base ends 5*a* of VO cams 5 each are not formed dividedly, assembling of various component parts for each cylinder should be carried out such that VO cams 5 are engaged with driving shaft 3 from both ends along the axial direction, then crank cam 4 which is a member separate and distinct from driving shaft 3 is fixed thereto by a pin and the like, requiring very complicated assembling work. On the other hand, in the first embodiment, due to divided formation of base ends 5*a*, VO cams 5 can be mounted from the radial direction of driving shaft 3 even if crank cam 4 is integrally formed with driving shaft 3 in advance.

Therefore, integration of driving shaft 3 with crank cam 4 can be achieved, resulting in enhanced assembling work as a whole.

Moreover, the axial projected area or diameter of integrated driving shaft 3 and crank cam 4 is smaller than the inner diameter of engagement hole 11*c* of crank arm 11, so that even with driving shaft 3 and crank arm 4 integrated with each other, it can be assembled crank arm 11 on outer peripheral surface 4*a* of crank cam 4, then VO cams 5 thereto from the radial direction. This leads to excellent assembling-ability of such members, achieving enhancement in assembling efficiency.

Figure 9:
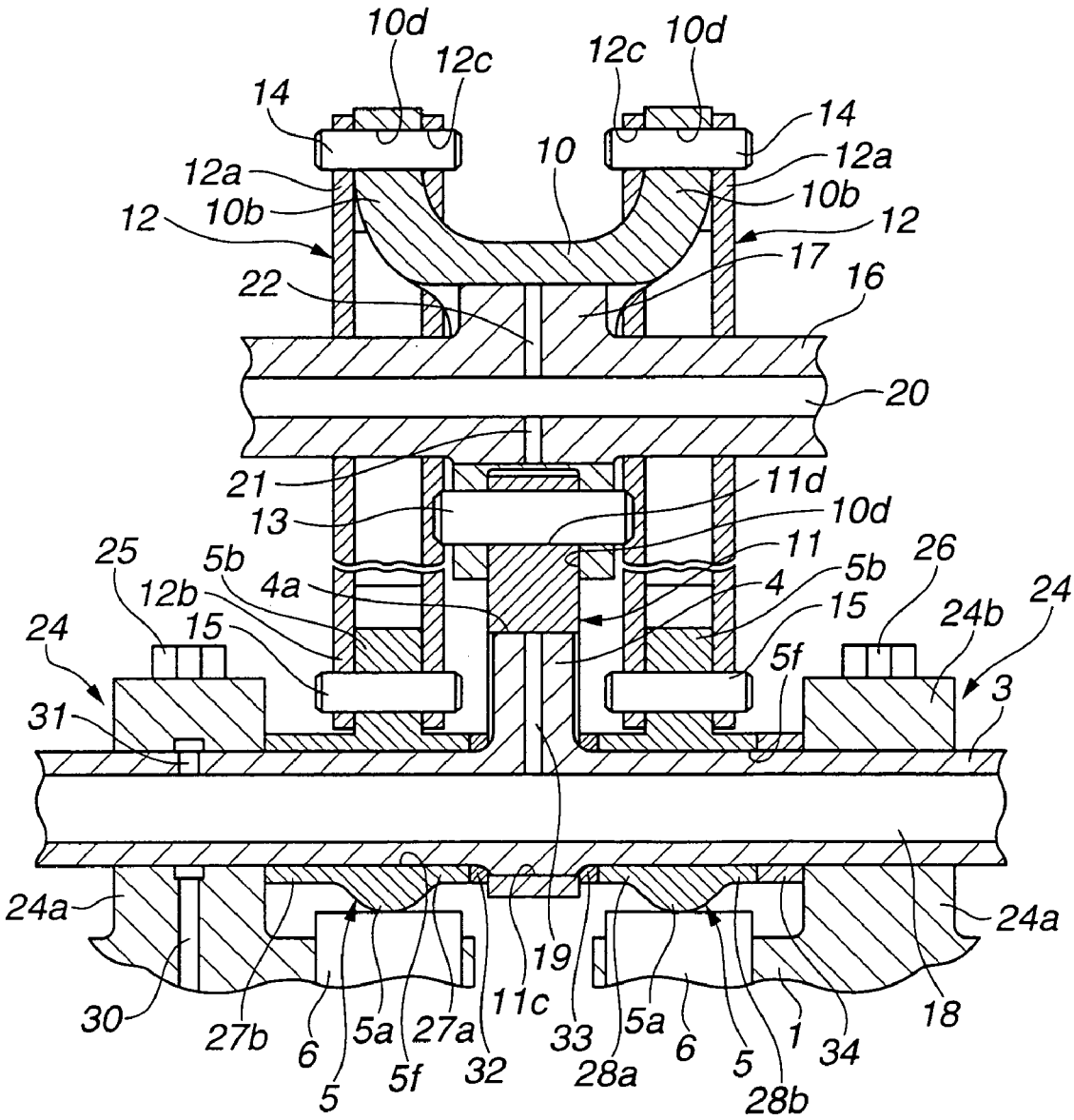
FIG. 9 is a view similar to FIG. 1, showing a second embodiment of the present invention.

Referring to FIG. 9, there is shown second embodiment of the present invention which is substantially the same as the first embodiment except that clearance adjusting shims 32–34 are arranged between inside extensions 27*a*, 28*a* of VO cams 5 and both side faces of annular portion 11*a* and right outside extension 28*b* and the inside face of right bearing 24.

Shims 32–34 have different axial lengths. Inside shims 32, 33 are of smaller axial length, and shaped roughly circularly, whereas outside shim 34 is of longer axial length, and shaped cylindrically.

Selective arrangement of shims 32–34 having different lengths provides the following advantage. Even if the axial lengths of extensions 27*a*, 27*b*, 28*a*, 28*b* vary due to forming and assembling errors and the like of component parts to make accurate positioning of VO cams 5 impossible, selective mounting of shims 32–34 allows adjustment of clearances between bearings 24 and annular portion 11*a*. Thus, axial free movement of annular portion 11*a* of crank arm 11 can be restricted securely.

Shims 32–34 may be prepared in advance having different axial lengths corresponding to the axial lengths of the clearances between bearings 24 and annular portion 11*a*, or adjusted in axial length after measuring the clearances.

Optionally, shims 32–34 may be replaced with simple spacers having given thicknesses. By way of example, when shim 32 is replaced with a spacer, the end face of VO cam 5 and the side face of crank arm 11, which swing separately, do not make direct contact with each other, preventing wear of the end face and side face. When shim 34 is replaced with a spacer, the side face of cylinder head 1 made of aluminum material or the like does not make direct contact with the end face of VO cam 5, preventing wear of the side face of bearing 24.

Referring to FIGS. 10–15, there is shown third embodiment of the present invention. The VA apparatus comprises a pair of intake valves 102 slidably provided to a cylinder head 100 through valve guides, not shown, a hollow driving shaft 103 disposed in the engine longitudinal direction, a crank cam 104 fixed to driving shaft 103 in a predetermined position, a pair of VO cams 105 supported slidably on driving shaft 103 and disposed symmetric with respect to crank cam 104 and for opening/closing intake valves 102 through valve lifters 106, a transmission mechanism 107 connected between crank cam 104 and VO cams 105 for transmitting torque of crank cam 104 to VO cams 105 as their swinging force or valve opening force, and a control mechanism 108 for varying the operating position of transmission mechanism 107.

Figure 10:
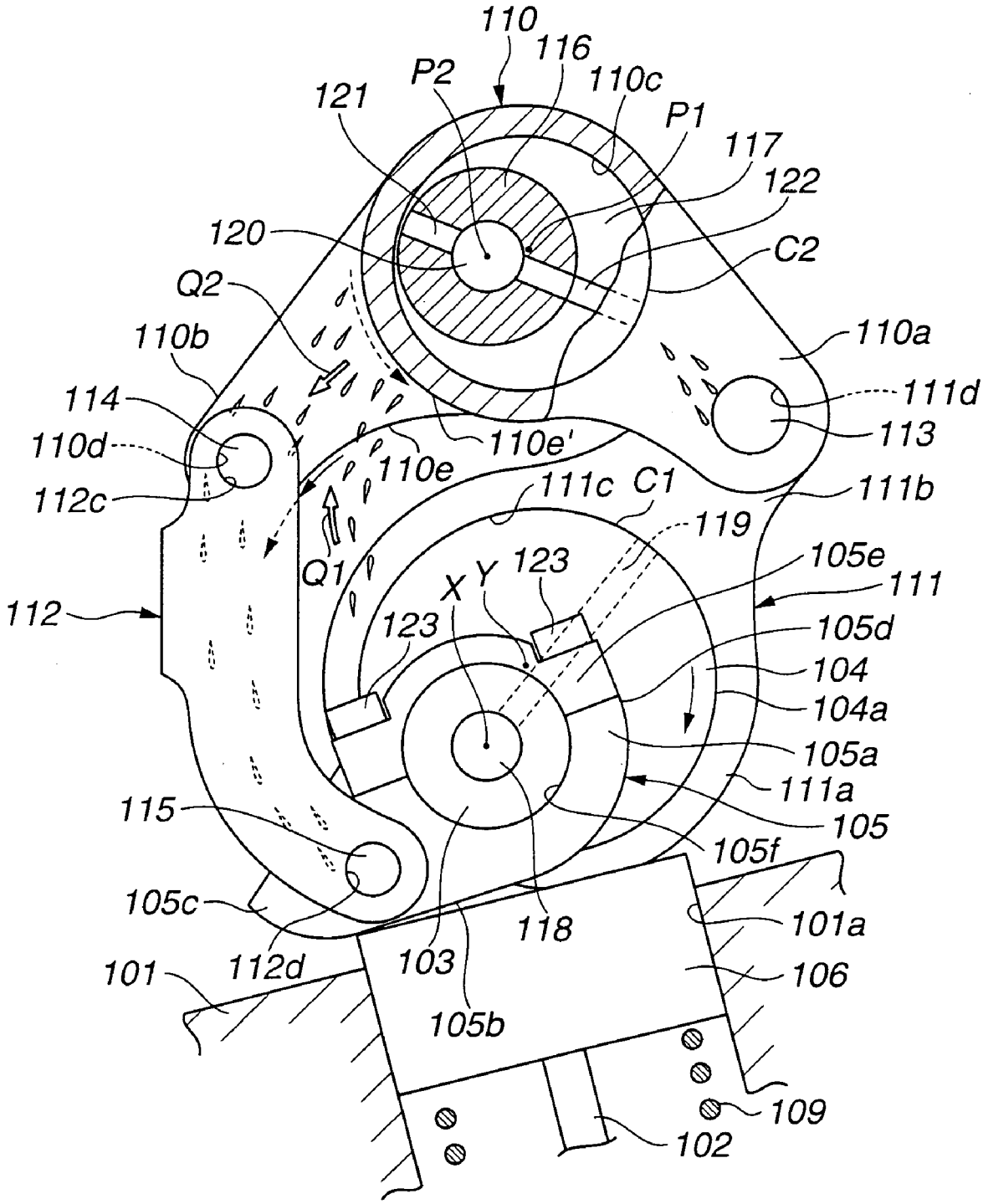
FIG. 10 is a view similar to FIG. 2, showing a third embodiment of the present invention.

Referring to FIG. 10, each intake valve 102 is biased in the closing direction by a valve spring 109 arranged between the bottom of a roughly cylindrical bore arranged in an upper end of cylinder head 101 and a spring retainer arranged at an upper end of a valve stem.

Driving shaft 103 is disposed along the engine longitudinal direction, and has both ends rotatably supported by bearings, not shown, arranged in an upper portion of cylinder head 101. Driving shaft 103 receives torque from an engine crankshaft through a driven sprocket arranged at one end, a timing chain wound on the driven sprocket, and the like, not shown. Driving shaft 103 is rotated clockwise as viewed in FIG. 10.

Figure 14:
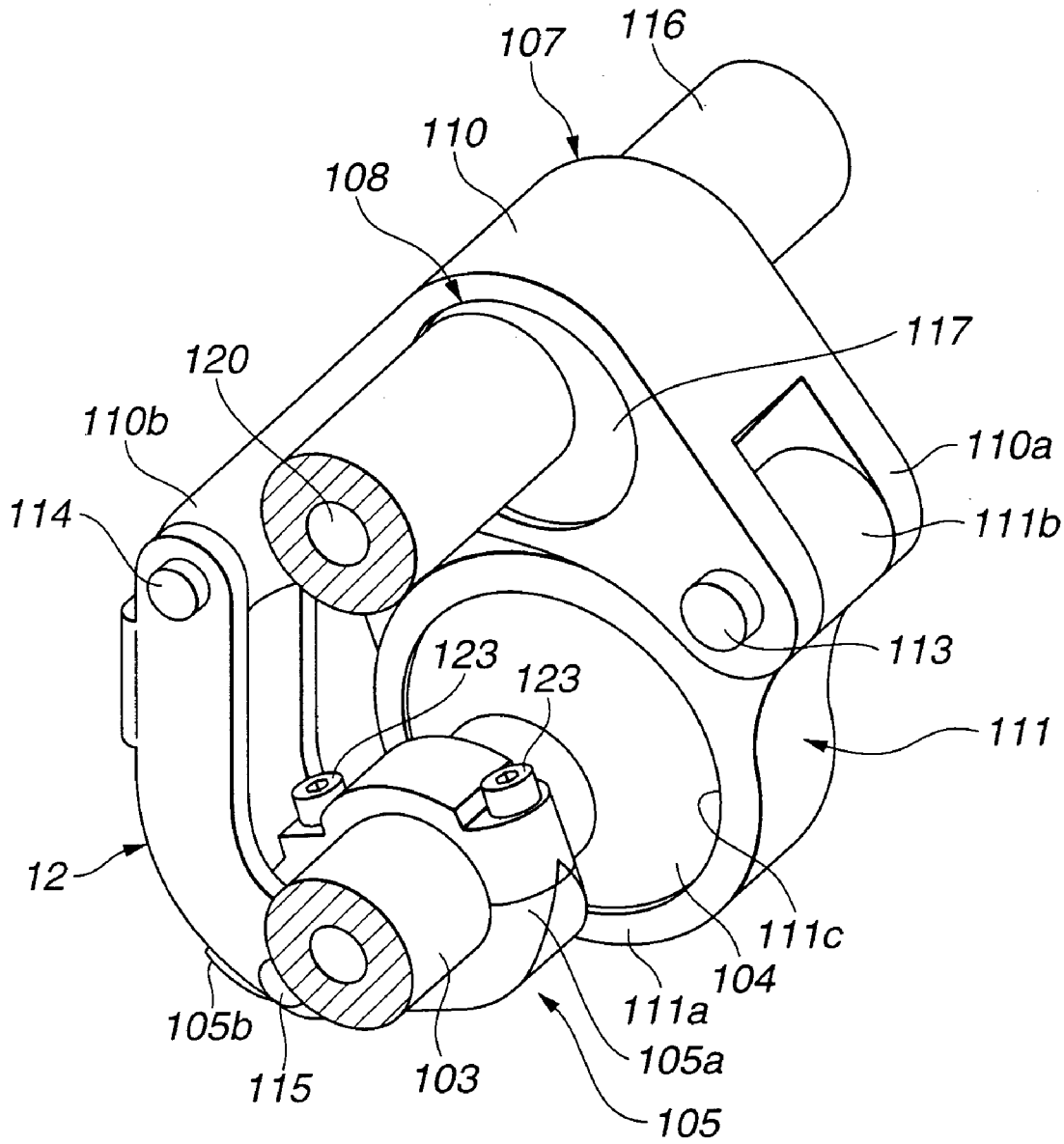
FIG. 14 is a view similar to FIG. 12, showing the VA apparatus in FIG. 10.
Figure 15:
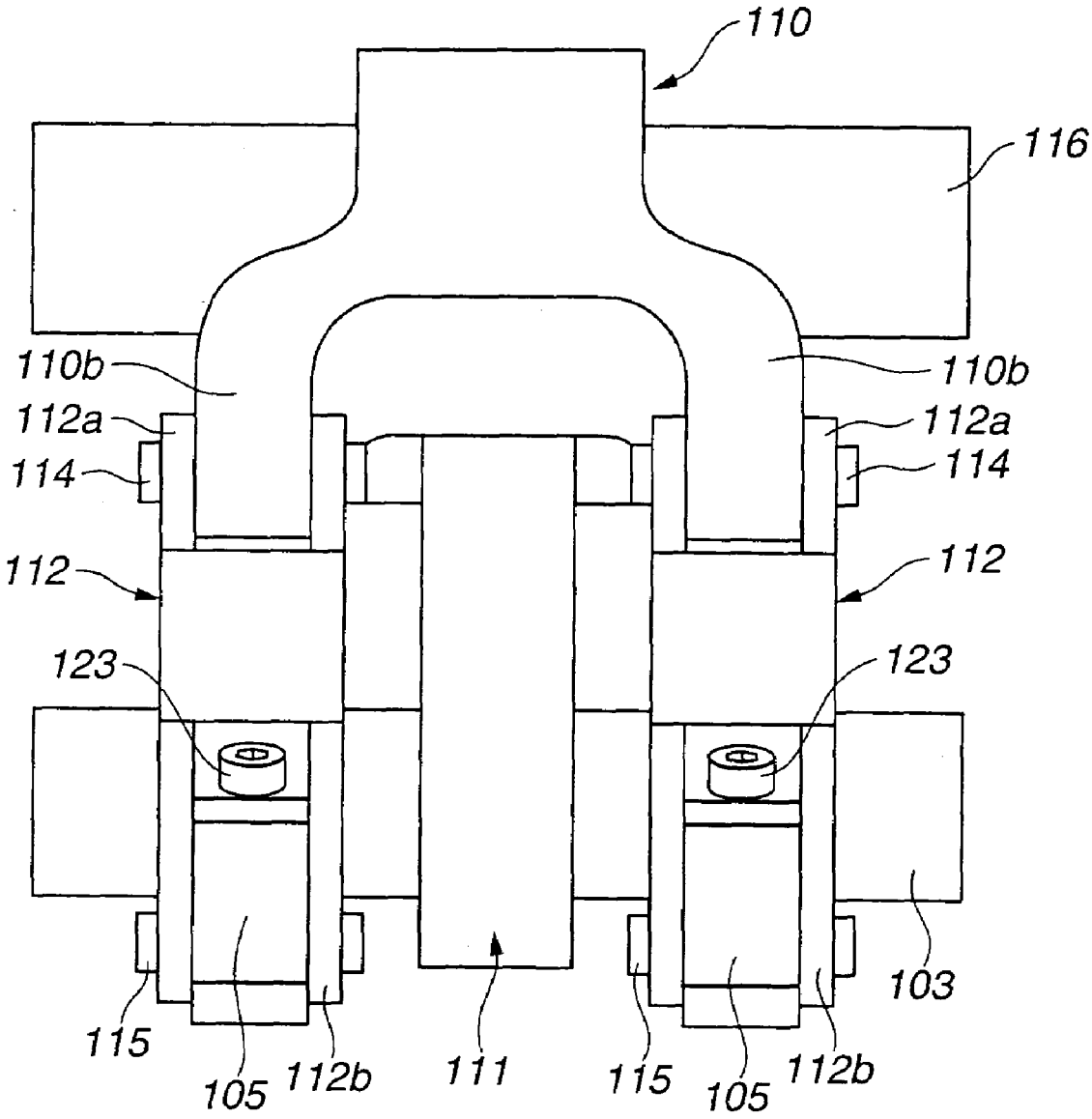
FIG. 15 is a view similar to FIG. 6, showing the VA apparatus in FIG. 10.

Referring to FIGS. 10 and 14, crank cam 104 having substantially a disc shape is integrated with driving shaft 103, and has a center Y offset with respect to an axis X of driving shaft 103 and an outer peripheral surface 104*a* formed with a cam profile of eccentric circle.

Referring to FIG. 10, VO earns 105 are both fanned roughly like a raindrop, and have a base end 105*a* constructed to swing about axis X of driving shaft 103 through a camshaft and a cam face 105*b* formed on the underside. Cam face 105*b* includes a base-circle face on the side of base end 105*a*, a ramp face circularly extending from the base-circle face to a cam nose 105*c*, and a lift face extending from the ramp face to a top face with maximum lift arranged at a front end of cam nose 105*e*. The base-circle face, the ramp face, the lift face, and the top face make contact with predetermined points of the top face of valve lifter 106 in accordance with the swinging position of VO cam 105.

Referring to FIG. 10, base end 105*a* of VO cam 105 includes upper and lower divisions 105*d*, 105*e* obtained with respect to driving shaft 103 and coupled by bolts 123 from the vertical direction. In the coupled state, upper and lower divisions 105*d*, 105*e* have semicircular inner surfaces formed on circular slide faces 105*f* which make slide contact with the outer peripheral surface of driving shaft 103.

Figure 12:
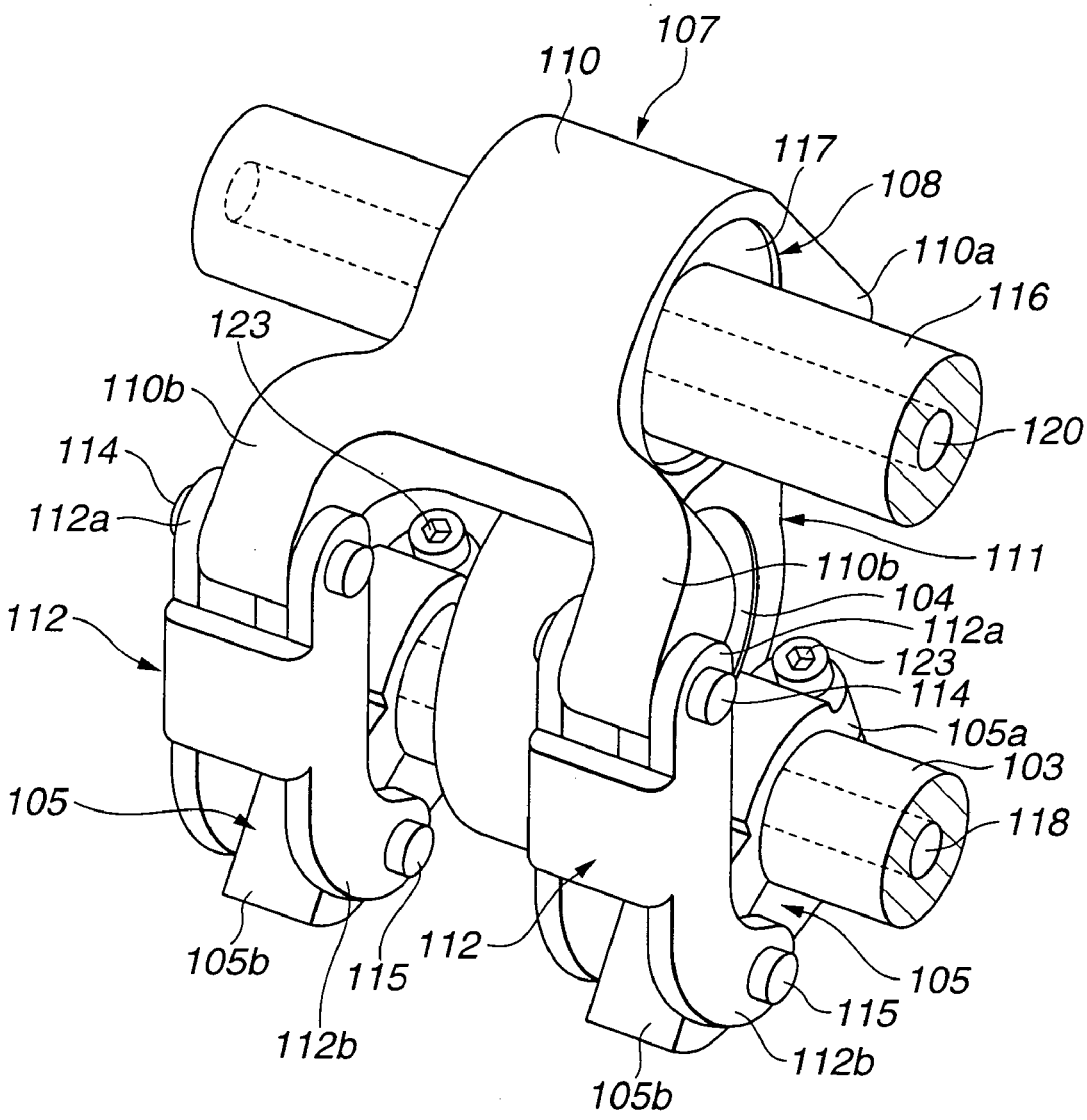
FIG. 12 is a view similar to FIG. 11, showing the VA apparatus in FIG. 10.
Figure 13:
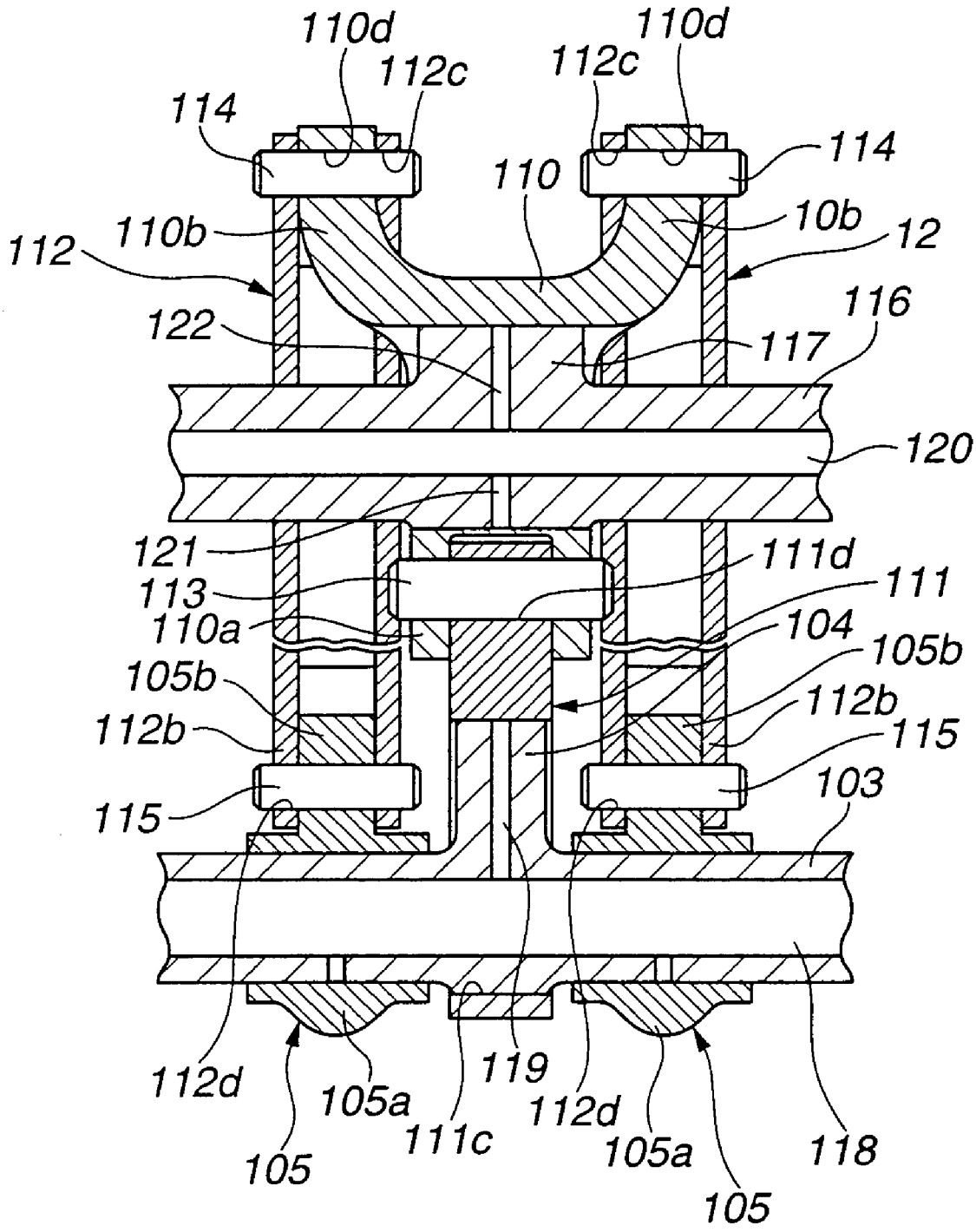
FIG. 13 is a view similar to FIG. 9, showing the VA apparatus in FIG. 10.

Referring to FIGS. 12 and 14, transmission mechanism 107 comprises a rocker arm 110 disposed above driving shaft 103, a crank arm 111 for linking a first arm 110*a* of rocker arm 110 with crank cam 104, and a pair of link rods 112 for linking a second arm 110*b* of rocker arm 110 with VO cams 105.

Figure 11:
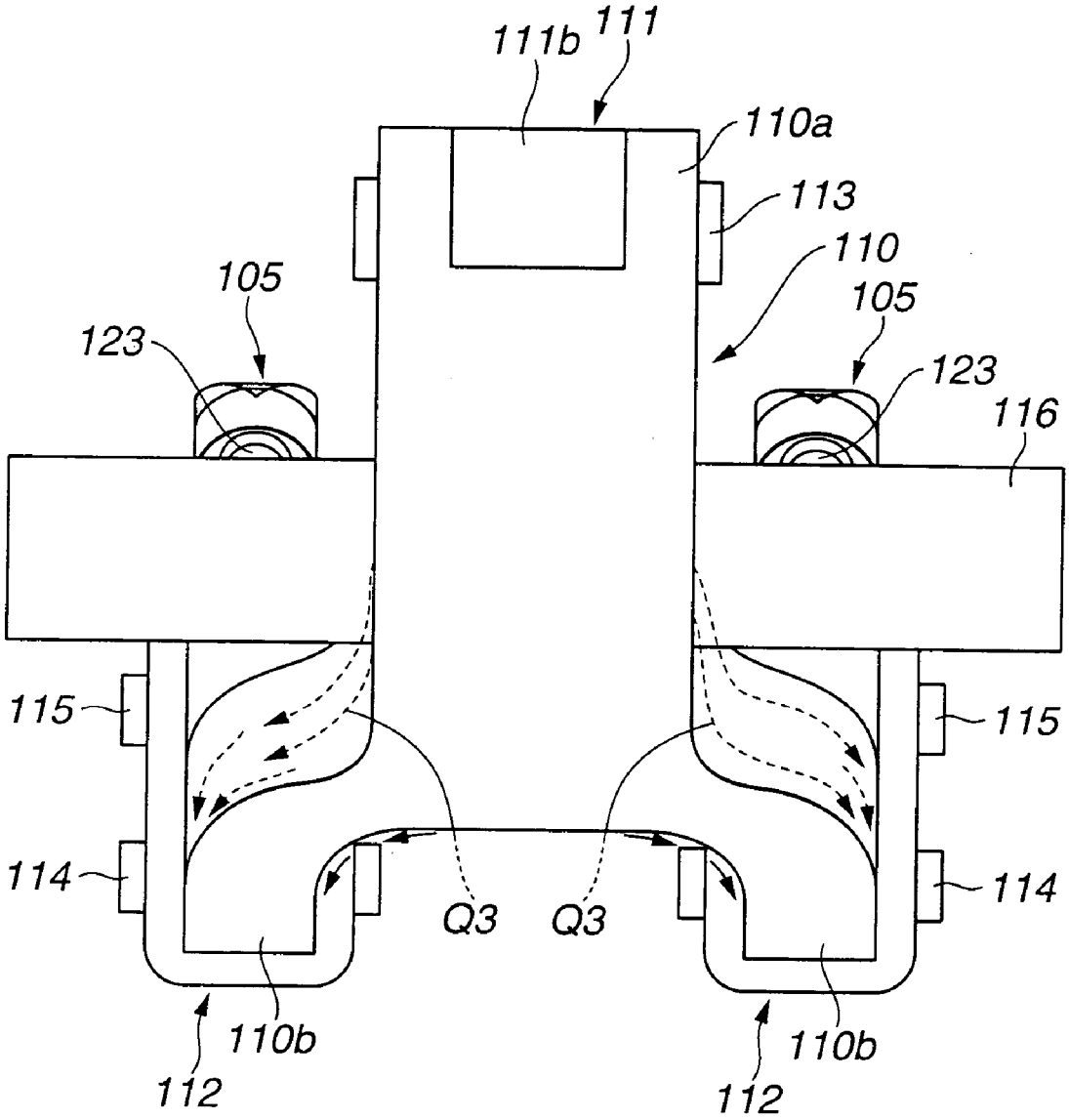
FIG. 11 is a view similar to FIG. 5, showing the VA apparatus in FIG. 10.

Rocker arm 110 has in the center a cylindrical base with a support hole 110*c* formed therethrough from the lateral direction as shown in FIG. 10 and through which rocker arm 110 is swingably supported by a control cam 117 as will be described later. Referring to FIG. 11, first arm 110*a* extending from one radial side of the cylindrical base has a pin 113 arranged therethrough, whereas second arm 110*b* extending from another radial side of the cylindrical base has two bifurcated portions corresponding to two VO cams 105. Bifurcated second arms 110*b* are disposed symmetric with respect to the cylindrical base, each having at a front end a pin hole 110*d* formed therethrough for receiving a pin 114 for coupling second arm 110*b* to a first end 112*a* of link rod 112. Snap rings are mounted to both ends of pins 113, 120 to prevent disengagement thereof. Moreover, bifurcated second arms 110*b* serve to transmit a rocking force to VO cams 105 through link rods 112 from above in the direction of gravitation. Second arms 110*b* are located axially roughly in the same positions with respect to VO cams 105.

Moreover, rocker arm 110 has a underside 110*e* facing crank cam 104 and including a concavely curved surface as a whole.

Referring to FIGS. 10 and 14, crank arm 111 includes a relatively large-diameter annular portion 111*a* and an extension 111*b* arranged in a predetermined position of the outer peripheral surface of annular portion 111*a*. Annular portion 111*a* has in the center an engagement hole 111*c* in which outer peripheral surface 104*a* of crank cam 104 is engaged rotatably. Extension 111 has a pin hole 111*d* in which pin 113 is engaged rotatably.

Referring to FIG. 12, link rod 112 is formed to have substantially a C-shaped cross section by press working, and has in the vicinity of each end 112*a*, 112*b* two facing plate portions formed with a pin hole 112*c*, 112*d*. Arranged through pin holes 112*c*, 112*d* are pin 114 for rotatably coupling end 112*a* to second arm 110*b* of rocker arm 110 and a pin 115 for rotatably coupling end 112*b* to cam nose 105*c* of VO cam 105.

Referring to FIGS. 12 and 14, control mechanism 108 comprises a control shaft 116 rotatably supported on a bearing, not shown, disposed above driving shaft 103, and a control cam 117 fixed to the outer periphery of control shaft 116 to form a rocking fulcrum of rocker arm 110.

Control shaft 116 is disposed parallel to driving shaft 103 to extend along the engine longitudinal direction, and is controlled in rotation within a predetermined angle of rotation through a gear mechanism by an electric actuator or DC motor, not shown, arranged at one end. Control cam 117 is shaped cylindrically, and has an axis P1 offset by an amount of the thick portion with respect to an axis P2 of control shaft 116.

The electric actuator is driven by a control signal of an electric control unit (ECU), not shown, for determining the engine operating conditions. The ECU comprises a microcomputer, and determines through computing and the like current engine operating conditions in accordance with detection signals of various sensors such as a crank-angle sensor, an airflow meter, a coolant-temperature sensor, and a potentiometer for detecting the rotated position of control shaft 116, providing a control signal to the electric actuator.

A lubricating-oil supply circuit is arranged to supply lubricating oil to the circumference of pins 113, 114, 115 in accordance with engine operation.

Specifically, referring to FIGS. 10 and 12, the lubricating-oil supply circuit comprises a first oil passage 118 formed through driving shaft 103 axially, a first communication passage 119 formed through crank cam 104 radially to provide fluid communication between first oil passage 118, outer peripheral face 104*a* of crank cam 104, and engagement hole 111*c* of crank arm 111, a second oil passage 120 formed through control shaft 116 axially, a diametral hole 121 formed through control shaft 116 diametrally to communicate with second oil passage 120, and a second communication passage 122 formed through a thick portion of control cam 117 radially to provide fluid communication between diametral hole 121, the inner surface of support hole 110*c* of rocker arm 110, and the outer surface of control cam 117.

First oil passage 118 and second oil passage 20 communicate with an oil introduction passage, not shown, extending from an oil gallery arranged in cylinder head 101 to the inside of the bearings for supporting driving shaft 103 and control shaft 116.

Figure 16A:
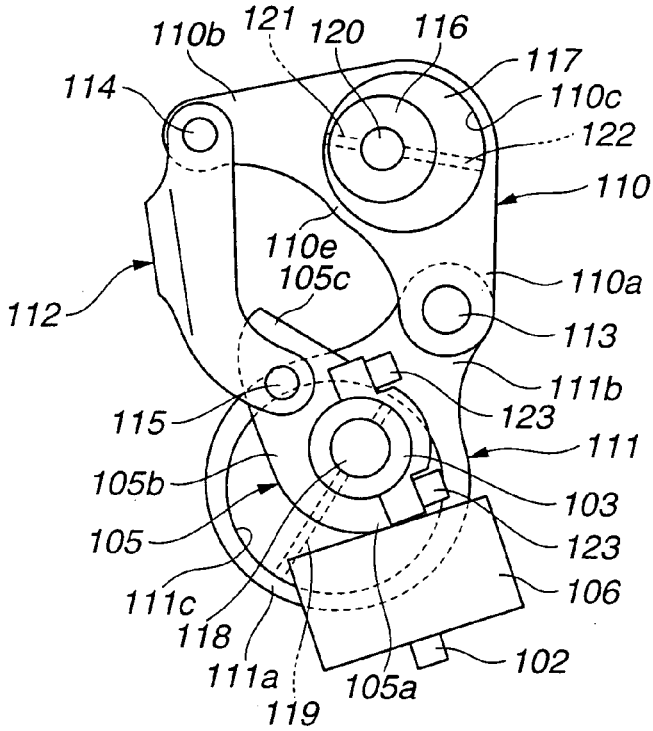
FIG. 16A is a view similar to FIG. 8B, for explaining closing operation of an intake valve during minimum lift control of the VA apparatus in FIG. 10.

Operation of the alteration mechanism in the third embodiment is described briefly. During low lift control, control shaft 116 is rotated in one direction by the electric actuator in accordance with a control signal of the ECU. Thus, referring to FIGS. 16A and 16B, the thick portion of control cam 117 is rotated rightward as viewed in FIGS. 16A and 16B with respect to control shaft 116, having control cam 117 held in this rotation-angle position. With this, second arm 110*b* of rocker arm 110 is rotated upward, so that cam nose 105*c* of VO cam 105 is forcedly pulled up through link rod 112, having VO cam 105 in its entirety held in a clockwise rotated position as shown in FIG. 16A.

Figure 16B:
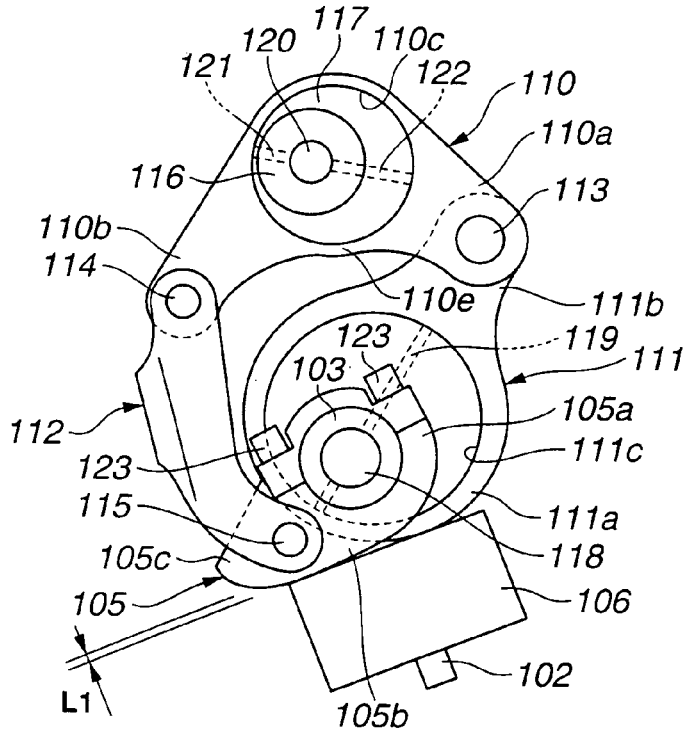
FIG. 16B is a view similar to FIG. 16A, for explaining opening operation of the intake valve during minimum lift control of the VA apparatus in FIG. 10.

Referring to FIG. 16B, when rotation of crank cam 104 urges crank arm 111 to pull up first arm 110*a* of rocker arm 110, a corresponding lift amount is transmitted to VO cam 105 and valve lifter 106 through link rod 112. Then, the lift amount is sufficiently small.

This leads to small valve lift amount L1 and delayed opening timing of intake valves 102, reducing valve overlap with the exhaust valves, thus obtaining enhancement in fuel consumption and stable engine rotation in the low load range, for example.

Figure 17A:
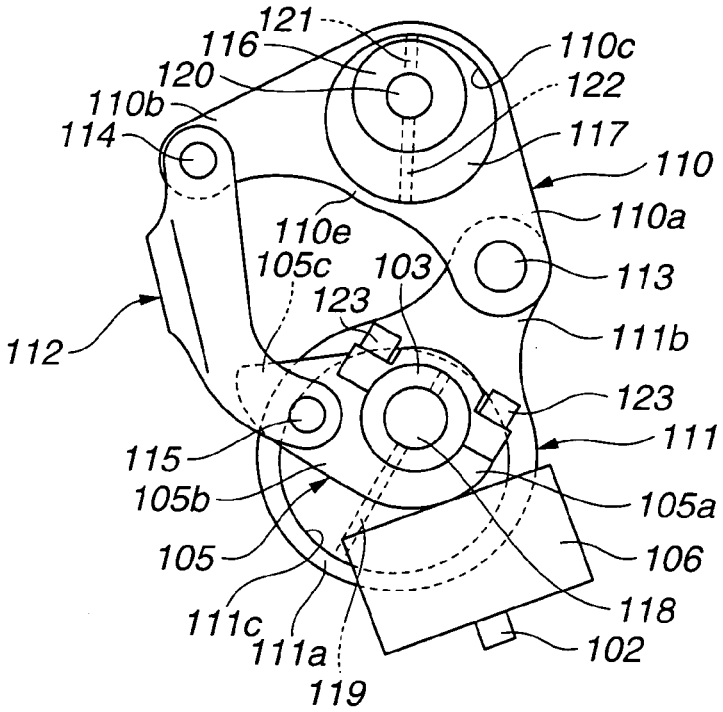
FIG. 17A is a view similar to FIG. 16B, for explaining closing operation of an intake valve during maximum lift control of the VA apparatus in FIG. 10.
Figure 17B:
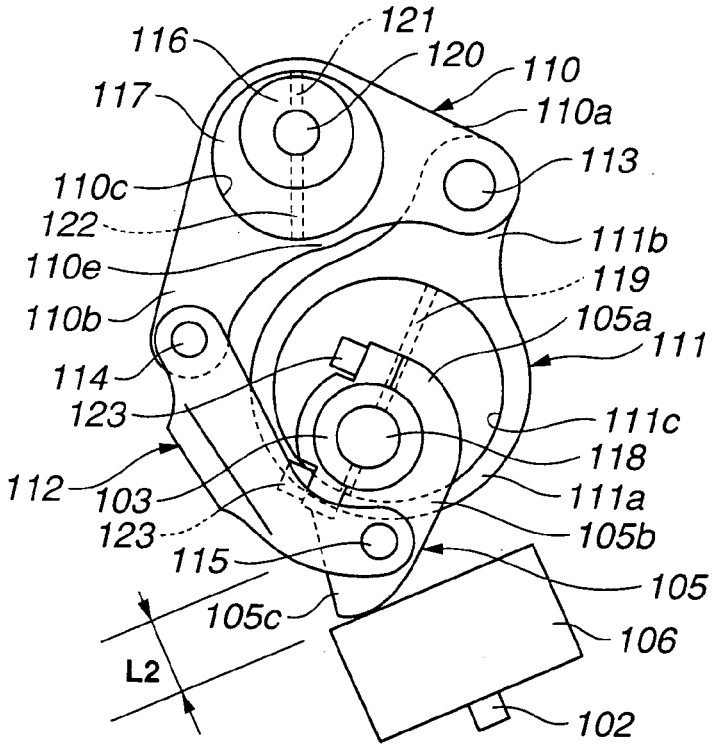
FIG. 17B is a view similar to FIG. 17A, for explaining opening operation of the intake valve during maximum lift control of the VA apparatus in FIG. 10.

On the other hand, during high lift control, control shaft 116 is rotated in another direction by the electric actuator in accordance with a control signal of the ECU. Thus, referring to FIGS. 17A and 17B, control shaft 116 rotates control cam 117 up to a predetermined rotation-angle position to have the thick portion moved downward. With this, second arm 110*b* of rocker arm 110 is rotated downward, so that cam nose 105*c* of VO cam 105 is pressed downward through link rod 112, having VO cam 105 in its entirety held in a clockwise rotated position as shown in FIG. 17B.

Therefore, the contact position of cam face 105*b* of VO cam 105 with respect to the top face of valve lifter 106 is moved on the side of cam nose 105*c*. Referring to FIG. 17B, when rotation of crank cam 104 urges crank arm 111 to pull up first arm 110*a* of rocker arm 110, a corresponding lift amount is large with respect to valve lifter 106.

This leads to large valve lift amount L2 and delayed closing timing of intake valves 102, obtaining enhancement in intake charging efficiency in the high load range and sufficient engine output, for example.

Next, operation of the lubricating-oil supply circuit in the third embodiment is described. Referring to FIG. 10, during engine operation, lubricating oil flowing into first oil passage 118 is supplied to a first slide clearance C1 between the inner peripheral surface of engagement hole 111*c* and outer peripheral surface 104*a* of crank cam 104 through first communication passage 119. Thus, forced lubrication is carried out between engagement hole 111*c* and crank cam 104.

After carrying out sufficient lubrication between the inner peripheral surface of engagement hole 111*c* and outer peripheral surface 104*a* of crank cam 104, lubricating oil flows out from slide clearance C1 due to high-speed eccentric rotation of crank cam 104. Lubricating oil is then splashed in the direction of rotation as shown by arrow Q1 in FIG. 10, i.e. in the direction of curved underside 110*e* or a cylindrical portion 110*e*' of rocker arm 110, which is adhered thereon.

Lubricating oil adhered on underside 110*e* or cylindrical portion 10*e*' is supplied, principally, to the circumference of pin 14 along the underside or inner surface of second arm 110*b* as shown by arrow Q2 in FIG. 10 due to centrifugal force and the like produced by rocking motion of rocker arm 110. Acceleration of this effect results from the structure of second arm 110*b* transmitting a rocking force to VO cam 105 through link rod 112 from above in the direction of gravitation.

On the other hand, lubricating oil flowing into second oil passage 120 is supplied to a second slide clearance C2 between the inner face of support hole 110*c* and the outer face of control cam 117 through diametral hole 121 and second communication hole 122. Thus, forced lubrication is carried out between control cam 117 and rocker arm 110.

Referring to FIG. 11, after carrying out lubrication between control cam 117 and rocker arm 110, lubricating oil flows out from slide clearance C2 to be supplied, principally, to the circumference of pin 114 along the outer surface of second arm 110*b* of rocker arm 110 as shown by arrows Q3. At pin 114, lubricating-oil flow Q3 merges in lubricating-oil flow Q2 proceeding along the inner side or lower side of second arm 110*b*, lubricating the circumference of pin 114.

Moreover, after lubricating the circumference of pin 114, lubricating oil flows down along the inner surface of link rod 112 by gravitation to be supplied to the circumference of lower pin 115. Second arms 110*b* of rocker arm 110 by which pins 114 are held are located above pins 115 as acting points of VO cams 105 in the direction of gravitation and in substantially the same axial positions with respect thereto, achieving more effective supply of lubricating oil to the circumference of pins 115.

This allows active lubrication to the circumference of pins 114,115 and pin holes 110*d*, 112*c*, 112*d*, obtaining enhanced lubrication performance at such sites, resulting in sufficient prevention of occurrence of wear thereof.

Further, after lubricating the circumference of pin 115, lubricating oil flows along the outer surface of VO cam 105, and goes from cam nose 105*c* to cam face 105*b* to be also supplied between cam face 105*b* and the top face of valve lifter 106 and between the outer peripheral surface of valve lifter 106 and a holding hole 101*a* of cylinder 101 in which valve lifter 106 moves slidingly, obtaining sufficient lubrication of such slide portions. This allows both achievement of always smooth slide operation and prevention of occurrence of wear thereof.

Still further, as shown in FIG. 10, lubricating oil flowing out from second slide clearance C2 flows along the outer peripheral surface of first arm 110*a* of rocker arm 110 by a centrifugal force resulting from swinging motion and the like of rocker arm 110, and it is supplied to the circumference of pin 113. This provides excellent lubrication performance of the circumference of pin 113.

Furthermore, in the third embodiment, VO cams 105 have base ends 105*a* each formed dividedly, allowing integration of driving shaft 103 and crank cam 104.

Specifically, when base ends 105*a* of VO cams 105 each are not formed dividedly, assembling of various component parts for each cylinder should be carried out such that VO cams 105 are engaged with driving shaft 103 from both ends along the axial direction, then crank cam 104 which is a member separate and distinct from driving shaft 103 is fixed thereto by a pin and the like, requiring very complicated assembling work. On the other hand, in the third embodiment, due to divided formation of base ends 105*a*, VO cams 105 can be mounted from the radial direction of driving shaft 103 even if crank cam 104 is integrated with driving shaft 103 in advance.

Therefore, integration of driving shaft 103 with crank cam 104 can be achieved, resulting in not only reduced number of parts, but also enhanced strength of driving shaft 103 due to no need of forming therein a pin hole and the like.

Moreover, the axial projected area or diameter of integrated driving shaft 103 and crank cam 104 is smaller than the inner diameter of engagement hole 111*c* of crank arm 111, so that even with driving shaft 103 and crank arm 104 integrated with each other, it can be assembled crank arm 111 on outer peripheral surface 104*a* of crank cam 104, then VO cams 105 thereto from the radial direction. This leads to excellent assembling-ability of such members, achieving enhancement in assembling efficiency.

As described above, according to the present invention, the annular portion of the crank arm is supported by the opposite inside end faces of the VO cams in the sandwiched state, i.e. in the state of producing no inconvenience to operation of the crank arm and the VO cams, having restricted free axial movement. As a result, the crank arm is prevented from being tilted, preventing occurrence of partial one-side collision between the inner peripheral surface of the annular portion and the outer peripheral surface of the crank cam. Therefore, wear of such sites is prevented from occurring, leading to a reduction in durability thereof.

Further, due to arrangement of the shim, the end face of the VO cam and the side face of the crank arm, which swing separately, do not make direct contact with each other, preventing wear of the end face and side face. Moreover, even if the width of the VO cams, i.e. the axial length of the driving shaft varies to make accurate positioning of the VO cams impossible, the shim allows adjustment of a clearance, securely restricting free axial movement of the annular portion of the crank arm.

Still further, due to arrangement of the lubricating-oil supply circuit, forced lubrication is carried out between the inner peripheral surface of the annular portion of the crank arm and the outer peripheral surface of the crank cam, obtaining enhanced lubrication performance therebetween. Therefore, in combination with restricting operation of free axial movement of the annular portion, wear of the annular portion and the crank cam can effectively be prevented from occurring.

Furthermore, lubricating oil flowing out between the inner peripheral surface of the annular portion of the crank arm and the outer peripheral surface of the crank cam is also supplied between the annular portion and the VO cams, obtaining enhanced lubrication performance therebetween.

Further, the outside end faces of the VO cams abut on the bearings to have restricted axial movement, allowing surer restriction of accidental axial movement of the crank arm.

Still further, during engine operation, lubricating oil supplied from the inside of the driving shaft to the outer peripheral surface of the crank cam is splashed from the outer peripheral surface by rotation of the crank cam, which is adhered on the crank-cam-side outer face of the arm portion of the rocker arm. Lubricating oil adhered on the outer face flows down along the outer face of the arm portion due to gravitation and swinging motion of the rocker arm, and it is actively supplied to the acting point of the VO cam, i.e. the circumference of a pivotal portion of the arm portion and the VO cam. This provides great enhancement in lubrication performance of the circumference of the pivotal portion, allowing prevention of occurrence of wear thereof.

Furthermore, lubricating oil splashed from the crank cam is easily received by the concave underside of the rocker arm having larger area. Moreover, lubricating oil adhered on the concave underside flows down easily along the curved surface thereof toward the VO cam and the pivotal point.

Further, due to arrangement of the alteration mechanism, an enhancement in engine performance can be obtained by varying the valve lift amount.

Furthermore, due to divided formation of the VO cams, the VO cams can be mounted from the radial direction of the driving shaft, allowing integration of the crank cam with the driving shaft in advance, resulting in enhanced assembling work as a whole.

Having described the present invention in connection with the illustrative embodiments, it is noted that the present invention is not limited thereto, and various changes and modifications can be made without departing from the scope of the present invention.

By way of example, the present invention can be applied not only the intake valves, but also the exhaust valves. Moreover, the present invention can be applied to an ordinary VO apparatus having no alteration mechanism.

Further, the rocker arm may be of the ordinary type having one end directly pressing the engine valves.

The entire teachings of Japanese Patent Application P2003-156166 filed Jun. 2, 2003 and Japanese Patent Application P2003-156165 file Jun. 2, 2003 are hereby incorporated by reference.

What is claimed is:

1. A valve actuation (VA) apparatus for an internal combustion engine, comprising:

a driving shaft which receives a torque of the engine;

a crank cam which receives a torque of the driving shaft, the crank cam having an axis eccentric with an axis of the driving shaft;

a crank arm comprising an annular portion to rotatably hold therein the crank cam, the crank arm converting the torque of the crank cam to a reciprocating force;

a rocker arm which swings by a driving force derived from the crank arm;

a pair of valve operating (VO) cams swingably supported on the driving shaft, the VO cams swinging by a rocking force derived from the rocker arm to drive engine valves, the VO cams being disposed on both sides of the crank cam, the VO cams directly holding therebetween the crank arm, the VO cams having inside end faces opposed to each other, the inside end faces having therebetween the annular portion of the crank arm supported in a sandwiched way from an axial direction of the driving shaft; and a pair of bearings used for the driving shaft and fixed to a cylinder, wherein the VO cams have outside end faces opposite to the inside end faces, the outside end faces being restricted in axial movement by the pair of bearings, and wherein the pair of VO cams and the crank arm are sandwiched between the pair of bearings in the axial direction.

2. The VA apparatus as claimed in claim 1, further comprising a lubricating-oil supply circuit which supplies a lubricating oil from an inside of the driving shaft to a space between the crank cam and the annular portion of the crank arm.

3. The VA apparatus as claimed in claim 1, further comprising:

a control shaft;

a control cam fixed on an outer periphery of the control shaft, the control cam having an outer peripheral surface for swingably supporting the rocker arm;

a link rod which links an arm portion of the rocker arm to the VO cams; and an alteration mechanism which varies a lift amount of the engine valves, wherein the control shaft and the control cam are controlled in rotation in accordance with engine operating conditions to vary a rocking fulcrum of the rocker arm, thereby changing slide positions of the VO cams with respect to the engine valves.

4. The VA apparatus as claimed in claim 1, wherein the driving shaft and the crank cam are integrated with each other.

5. The VA apparatus as claimed in claim 1, wherein the VO cams each comprises upper and lower divisions, wherein when coupled to each other by a coupling member, the divisions make slide contact with an outer peripheral surface of the driving shaft.

6. The VA apparatus as claimed in claim 5, wherein the coupling member comprises a bolt.

7. The VA apparatus as claimed in claim 1, wherein the VO cams each have a cylindrical slide face makes slide contact with the outer peripheral surface of the driving shaft.

8. The VA apparatus as claimed in claim 1, wherein the crank arm and the rocker arm are rotatably coupled together by a pin.

9. The VA apparatus as claimed in claim 8, wherein the rocker arm is formed with a recess, wherein the crank arm is rotatably coupled to the rocker arm in the state of being arranged in the recess.

10. The VA apparatus as claimed in claim 1, wherein the annular portion of the crank arm has an axial thickness greater than an axial thickness of the crank cam 4.

11. The VA apparatus as claimed in claim 1, wherein the VO cams are disposed substantially symmetric with respect to the crank cam, the rocker arm comprising an arm portion for transmitting the rocking force to acting points of the VO cams from above in a direction of gravitation, the VA apparatus further comprising:

a control shaft to which the rocker arm is provided swingably; and a lubricating-oil supply circuit which supplies a lubricating oil from an inside of the driving shaft to an outer peripheral surface of the crank cam, and from an inside of the control shaft to the rocker arm.

12. The VA apparatus as claimed in claim 11, wherein the rocker arm has a underside facing the crank cam, the underside including a concavely curved surface.

13. The VA apparatus as claimed in claim 12, further comprising:

a control cam fixed on an outer periphery of the control shaft, the control cam having an outer peripheral surface for swingably supporting the rocker arm;

a link rod which links an arm portion of the rocker arm to the VO cams; and an alteration mechanism which varies a lift amount of the engine valves, wherein the control shaft and the control cam are controlled in rotation in accordance with engine operating conditions to vary a rocking fulcrum of the rocker arm, thereby changing slide positions of the VO cams with respect to the engine valves.

14. The VA apparatus as claimed in claim 11, wherein the VO cams each comprises a base including upper and lower divisions, the base serving as a rocking fulcrum of the VO cam.

15. The VA apparatus as claimed in claim 1, wherein a positional variation in a fulcrum of revolution of the rocker arm is configured to occur away from the axis of the driving shaft.

16. A valve actuation (VA) apparatus for an internal combustion engine, comprising:

a driving shaft which receives a torque of the engine;

a crank cam which receives a torque of the driving shaft, the crank cam having an axis eccentric with an axis of the driving shaft;

a crank arm comprising an annular portion to rotatably hold therein the crank cam, the crank arm converting the torque of the crank cam to a reciprocating force;

a rocker arm which swings by a driving force derived from the crank arm;

a pair of valve operating (VO) cams swingably supported on the driving shaft, the VO cams swinging by a rocking force derived from the rocker arm to drive engine valves, the VO cams being disposed on both sides of the crank cam, the VO cams having inside end faces opposed to each other;

a shim arranged at least between one of the inside end faces of the VO cams and the crank arm, the shim and the inside end faces of the VO cams cooperating to have therebetween the annular portion of the crank arm supported in a sandwiched way from an axial direction of the driving shaft and a pair of bearings used for the driving shaft and fixed to a cylinder, wherein the VO cams have outside end faces opposite to the inside end faces, the outside end faces being restricted in axial movement by the pair of bearings, and wherein the pair of VO cams and the crank arm are sandwiched between the pair of bearings in the axial direction.

17. The VA apparatus as claimed in claim 16, wherein the shim has a length adjustable in accordance with an axial length of the clearance.

18. The VA apparatus as claimed in claim 16, wherein the shim includes a spacer for reducing a wear.

19. The VA apparatus as claimed in claim 16, wherein a positional variation in a fulcrum of revolution of the rocker arm is configured to occur away from the axis of the driving shaft.

20. A valve actuation (VA) apparatus for an internal combustion engine, comprising:

a driving shaft which receives a torque of the engine;

a crank cam which receives a torque of the driving shaft, the crank cam having an axis eccentric with an axis of the driving shaft;

a crank arm comprising an annular portion to rotatably hold therein the crank cam, the crank arm converting the torque of the crank cam to a reciprocating force;

a rocker arm which swings by a driving force derived from the crank arm;

a pair of valve operating (VO) cams swingably supported on the driving shaft, the VO cams swinging by a rocking force derived from the rocker arm to drive engine valves, the VO cams being disposed on both sides of the crank cam, the VO cams having inside end faces opposed to each other, the inside end faces having therebetween the annular portion of the crank arm supported in a sandwiched way from an axial direction of the driving shaft; and a pair of bearings that rotatably support the driving shaft, wherein the VO cams have outside end faces opposite to the inside end faces, the outside end faces being restricted in axial movement by the pair of bearings, and wherein the pair of VO cams and the crank arm are sandwiched between the pair of bearings in the axial direction.

21. The VA apparatus as claimed in claim 20, wherein a positional variation in a fulcrum of revolution of the rocker arm is configured to occur away from the axis of the driving shaft.

22. A valve actuation (VA) apparatus for an internal combustion engine, comprising:

a driving shaft;

a crank cam integrally formed with the driving shaft, the crank cam having a disc shape and an axis eccentric with an axis of the driving shaft;

a crank arm comprising a single member, the crank arm comprising an annular portion to rotatably hold therein the crank cam, the crank arm converting a torque of the crank cam to a reciprocating force, the annular portion having an area greater than an axial projected area of the crank cam;

a rocker arm that swings by a driving force derived from the crank arm;

a pair of valve operation (VO) cams, the VO cams each comprising upper and lower divisions, the VO cams being swingably supported on the driving shaft on both sides of the crank cam with the divisions coupled to each other by a coupling member, the VO cams swinging by a rocking force derived from the rocker arm to drive engine valves, the VO cams having inside end faces opposed to each other, the inside end faces holding therebetween the annular portion of the crank arm; and a pair of bearings that rotatably support the driving shaft, wherein the VO cams have outside end faces opposite to the inside end faces, the outside end faces being restricted in axial movement by the pair of bearings, and wherein the pair of VO cams and the crank arm are sandwiched between the pair of bearings in the axial direction.

23. The VA apparatus as claimed in claim 22, wherein a positional variation in a fulcrum of revolution of the rocker arm is configured to occur away from the axis of the driving shaft.

* * * * *